US009375380B2

(12) United States Patent
Jowett et al.

(10) Patent No.: US 9,375,380 B2
(45) Date of Patent: Jun. 28, 2016

(54) MOBILITY ASSISTANCE DEVICE

(75) Inventors: E. Craig Jowett, Rockwood, CA (US); Christopher D. Jowett, Rockwood, CA (US)

(73) Assignee: ROWANWOOD IP INC., Rockwood (CA)

( * ) Notice: Subject to any disclaimer, the term of this patent is extended or adjusted under 35 U.S.C. 154(b) by 1767 days.

(21) Appl. No.: 11/747,265

(22) Filed: May 11, 2007

(65) Prior Publication Data

US 2008/0276977 A1 Nov. 13, 2008

(51) Int. Cl.
*A61H 3/04* (2006.01)

(52) U.S. Cl.
CPC ..... *A61H 3/04* (2013.01); *A61H 2003/046* (2013.01); *A61H 2201/1633* (2013.01)

(58) Field of Classification Search
CPC ..... A61H 3/04; A61H 2201/1633; A61H 2003/046; A47C 3/04
USPC ..... 135/66–67, 85; 280/87.021, 87.041, 280/87.051; 482/66–68; 296/5–6; 297/5–6, 297/294, 239, 249
See application file for complete search history.

(56) References Cited

U.S. PATENT DOCUMENTS

| | | | | |
|---|---|---|---|---|
| 130,283 | A | | 8/1872 | Darrach |
| 2,305,249 | A | * | 12/1942 | Frost ..... 297/6 |
| 2,565,257 | A | * | 8/1951 | Nichol ..... 482/68 |
| 2,672,916 | A | * | 3/1954 | Kenney ..... 297/287 |
| 3,195,550 | A | | 7/1965 | Ingalls et al. |
| 3,333,888 | A | | 8/1967 | Williams et al. |
| 3,354,893 | A | | 11/1967 | Schmerl |
| 3,498,667 | A | | 3/1970 | Winters |
| 3,800,815 | A | | 4/1974 | Birk |
| 4,226,467 | A | * | 10/1980 | Boudreau ..... 297/5 |
| 4,251,105 | A | | 2/1981 | Barker et al. |
| D277,561 | S | | 2/1985 | Erfurth |
| 4,510,956 | A | * | 4/1985 | King ..... 482/68 |
| 4,559,962 | A | * | 12/1985 | Marchiano ..... 135/85 |
| 4,682,782 | A | * | 7/1987 | Mills ..... 280/33.993 |
| 4,770,410 | A | * | 9/1988 | Brown ..... 482/68 |
| 4,800,910 | A | * | 1/1989 | Gamm ..... 135/67 |
| 5,158,313 | A | | 10/1992 | Becker |
| 5,228,708 | A | * | 7/1993 | Verdugo ..... 280/200 |
| 5,301,968 | A | * | 4/1994 | Ward et al. ..... 280/87.021 |
| 5,311,880 | A | | 5/1994 | Lancaster et al. |
| 5,320,122 | A | * | 6/1994 | Jacobson et al. ..... 135/66 |
| 5,378,215 | A | | 1/1995 | Harkins |

(Continued)

FOREIGN PATENT DOCUMENTS

| | | |
|---|---|---|
| CA | 2503928 | 10/2005 |
| EP | 0088035 | 7/1983 |

(Continued)

OTHER PUBLICATIONS

U-Step; Sammons Preston Rolyan; Copyright 2006 Patterson Medical Products, Inc.; http://www.sammonspreston.com/ca/Supply/Product.asp?Leaf_Id=552871.

(Continued)

*Primary Examiner* — Winnie Yip
(74) *Attorney, Agent, or Firm* — Philip C. Mendes da Costa; Bereskin & Parr LLP/S.E.N.C.R.L., s.r.l.

(57) ABSTRACT

A walker frame is provided which has a generally open space frame and has handle portions that are cantilevered.

7 Claims, 20 Drawing Sheets

(56) References Cited

U.S. PATENT DOCUMENTS

| | | | | |
|---|---|---|---|---|
| 5,538,268 | A | 7/1996 | Miller | |
| D399,626 | S * | 10/1998 | Taylor | D34/23 |
| 6,170,854 | B1 * | 1/2001 | Maher et al. | 280/648 |
| D448,706 | S | 10/2001 | Ferm | |
| D475,323 | S * | 6/2003 | Hallgrimsson | D12/130 |
| 6,595,530 | B2 | 7/2003 | Wood | |
| 6,607,202 | B1 | 8/2003 | Palmer | |
| 6,712,744 | B2 * | 3/2004 | Buechel et al. | 482/142 |
| 6,733,018 | B2 | 5/2004 | Razon | |
| D501,432 | S | 2/2005 | Moller | |
| 6,899,660 | B1 | 5/2005 | Chin et al. | |
| 6,935,353 | B2 | 8/2005 | Hawkes et al. | |
| 6,948,727 | B1 | 9/2005 | Bakken | |
| 7,001,313 | B1 | 2/2006 | Crnkovich | |
| 7,003,849 | B2 | 2/2006 | Cohen et al. | |
| 7,364,171 | B2 * | 4/2008 | Hu | 280/47.38 |
| 2003/0148858 | A1 * | 8/2003 | Jones | 482/66 |
| 2004/0239061 | A1 | 12/2004 | Chen | |

FOREIGN PATENT DOCUMENTS

| | | | | |
|---|---|---|---|---|
| EP | 0703101 | | 3/1996 | |
| JP | 11253506 | | 9/1999 | |
| JP | 2000084015 | | 3/2000 | |
| JP | 2001299843 | | 10/2001 | |
| JP | 2004121780 | A * | 4/2004 | A61G 5/02 |
| JP | 2004222879 | A * | 8/2004 | A61H 3/04 |
| JP | 2007215636 | | 8/2007 | |
| JP | 2007236997 | | 9/2007 | |
| WO | 2005/020867 | | 3/2005 | |
| WO | 2005/074855 | | 8/2005 | |
| WO | 2005074855 | A1 | 8/2005 | |

OTHER PUBLICATIONS

Eva Support Walker. Electric Eva Walker; Sammons Preston; Copyright 2007 Patterson Medical Products, Inc.; http://www.sammonspreston.com/Supply/Product.asp?Leaf_Id=926997.

The U-Step Walking Stabilizer; InStep Mobility—Stop Falls and Increase Mobility; http://www.ustep.com/walker.htm.

Rolyan ATO Walker with Split-Sectioned Padding—Model A370-100; Pro-Med Products; http://www.promedproducts.com/s.nl/it.A/id.1335/.f.

International Search Report and Written Opinion received on the corresponding international patent application No. PCT/CA2008/000815, mailed on Jul. 18, 2008.

Abstract of JP2007236997 (Eisaku); data supplied from the espacenet database—bibliographic data.

Abstract of JP2007215636 (Yanagihara N.); data supplied from the espacenet database—bibliographic data.

Abstract of JP2001299843 (Mitsuru Y.); data supplied from the espacenet database—bibliographic data.

Abstract of JP11253506 (Senji); data supplied from the espacenet database—bibliographic data.

Abstract of JP2000084015 (Michio, N.); data supplied from the espacenet database—bibliographic data.

* cited by examiner

MOBILITY ASSISTANCE DEVICE

FIELD OF THE INVENTION

This invention relates to a device to assist people, especially the elderly or disabled, to travel under their own power. In a particularly preferred embodiment, the present invention relates to a walker.

BACKGROUND OF THE INVENTION

Mature adults, including the elderly, typically suffer a decrease in mobility as they age. This may include loss of stability as well as a loss of strength in the lower limbs requiring the use of canes, crutches or the like to permit a person to continue to travel under their own power without the assistance of another person. In addition, some disabled individuals or individuals undergoing rehabilitation therapy may require assistance walking.

Various different types of walkers and stabilization devices have been developed to assist the elderly, as well as individuals recovering from an accident or surgery. For example, Crnkovich (U.S. Pat. No. 7,001,313) discloses an exercise assistance device that uses an upper handle bar connected to a base having four spaced apart wheels. Other examples include Moller (U.S. D501,432), Erfurth (U.S. D277,561), Ferm (U.S. D448,706) and Becker (U.S. Pat. No. 5,158,313). In addition, stabilization devices, such as may be used to assist children to learn to skate, are also known (see for example Jones, US 2003/0148858).

One disadvantage with some of these devices is that they utilize a complicated construction thereby increasing the complexity of the device and the cost of the device. In addition, some of the devices are not well adapted to assist the elderly or incapacitated to walk. For example, they may not provide an enclosure to essentially surround the person using the device, and therefore not offer any side-to-side stability. A further disadvantage of some of these devices is that they do not provide latitude in hand-holds location depending on activity or personal preference of the user. For example, when only a single hand-hold location is provided, the user's posture is typically bent at the waist to push the walker in front, and the user cannot have a preferred erect posture when using these walkers. A further disadvantage of existing walker frames is that they are not designed to provide adequate suspension for mobility over rough outdoor surfaces. Further, some walker frames are not configured to affix accessories such as child carriers, flexible seats, and sun shades in a safe and easy manner.

SUMMARY OF THE INVENTION

In accordance with this invention, a space frame is provided which may be utilized as a walker. The space frame has a generally open area, which may be mounted on wheels. The space frame defines an enclosure that essentially surrounds the person using the device.

In accordance with a first aspect of this invention, the walker has a generally U-shaped lower portion and a generally U-shaped upper portion wherein the upper portion is cantilevered. For example, the rear end of each of the upper and lower U-shaped portions may be secured together by generally vertically extending support members. Alternately, the support members may be positioned at any location on the lower portion. For example, the lower portion may be provided with a pair of front wheels and a pair of rear wheels and the support members may extend from a position between the front and rear wheels to the upper portion (e.g., the rear of the upper portion or a middle portion of the upper portion). In another example, the upper portions may extend upwardly and rearwardly from the front end of the lower portion to the upper portion (e.g., the rear of the upper portion or a middle portion of the upper portion). Accordingly, the front end of the upper portion may deflect, to some degree, upwardly or downwardly so as to provide a spring-like action. For example, if a user is traveling along an uneven surface (e.g. the wheels of the walker travel across a pot hole or uneven crack in the surface of a side walk), the cantilevered upper portion will act like a shock absorber to reduce the effect of the impact on the hands and arms of a user and to allow the wheels to roll over the uneven surface more readily than if the frame were rigid. Similarly, in the case where the frame is cantilevered by one or more support members attached at the rear, downward force exerted by the user's hands upon the upper portion is transferred to the base portion near the rear wheels, and not near the front wheels. The front wheels, thus being less weighted than the rear, can more readily bounce over small impediments on the travel surface, by deflecting the base portion of the cantilevered frame upward in a spring-like action, without impeding forward travel. In a particularly preferred embodiment, the wheels or other surface contacting members are mounted on the frame so that downward force exerted by the user's hands, or body if the user leans too far sideways, will be transferred to the base portion between the rear and the front wheels, and not rearward of the rear wheels, for a more structurally stable walker. For mobility across softer material such as sand or snow, low pressure, wide wheels or skis may be attached to the frame, allowing the user greater latitude in outdoor accessibility.

This preferred embodiment provides a method for easier turning of a three- or four-wheeled walker. A conventional walker carries a load typically toward the front of the walker, and the weight of the load is transferred down to the front wheels. This configuration moves the turning fulcrum of the walker toward the front, making it more difficult to turn from the handles at the rear of the walker. In one preferred embodiment, a rear-cantilevered walker is provided wherein the rear wheels are preferentially weighted, even if a carry basket or child seat is positioned at the front end of the upper portion. The weight is translated down through the support member or members to near the rear wheels, leaving the front wheels relatively unweighted, with the centre of mass effectively toward the rear of the walker rather than the front.

In one embodiment, a carry basket and/or a child seat may be positioned at the front end of the upper portion. In such an embodiment, the construction will reduce jolts that items in the carry basket or a child may otherwise be subjected to if the frame were rigid.

In accordance with another aspect of this invention, the walker has generally horizontally extending handle sections. For example, the walker may have a generally U-shaped upper portion that has spaced apart, opposed generally parallel side members that extend generally horizontally. These handle sections may have a longitudinal extent of, e.g. 1-3 feet and may be positioned at an ergonomic height for a user (e.g. from about 20" to about 36" from the ground for an adult; shorter for a child or youth). Accordingly, a user need not grip the walker in only a single location. Instead, a longitudinally extending handgrip portion is provided at an appropriate ergonomic height for a user thereby increasing the ease with which the walker may be utilized. In a preferred embodiment, the upper portion is U-shaped with an open rear section and generally horizontal side members that may be slightly elevated toward the front where they join, which act as elongated handle sections. The user may enter the frame and hold the handle sections at the side of the body with arms spaced wider in a relaxed position, or alternatively the user may hold the handle sections in front of the body in a narrower spacing, also in a relaxed position. This arm motion mimics the natural circular motion made when arms are swung from the shoulder joint, with the hands being at a wider spacing and slightly lower at the side of the body, to narrower spacing and slightly higher in the front. The benefits of this design are that the arms are in a relaxed natural position when holding the front or side of the upper side members allowing the user to maintain an erect posture while using the device, and the handle sections can be used comfortably when stationary, moving slowly, or when moving rapidly. If a user prefers to rest their forearms on the side handle sections to push the walker, the upper portion handle sections would be at a greater height than if the user were using their hands at their side. This greater height can be fixed for permanent use, or preferably adjusted for height of the handle section as the user prefers at that time. This may be achieved by having the upper portion telescopically mounted on the base portion.

In a particularly preferred embodiment, a plurality of wheels is affixed to the frame so as to define a walker. However, it will be appreciated that skis, skids, glides or the like may be affixed to the walker frame such that the walker may slide over a surface. For example, if the walker is to be used in an area that has a significant amount of snow in the winter, one or more skis may be affixed, e.g., to the front end of the lower portion and wheels may be affixed to the rear end of the lower portion. In a further alternate embodiment, skis may be provided on both the front and rear ends of the lower portion.

In accordance with one embodiment of the instant invention, there is provided a walker frame for assisting a person traveling over a surface, the walker frame comprising:

(a) a generally U-shaped base portion comprising a front end and a rear end and including first and second generally longitudinally extending, spaced apart, opposed side members that define a generally open area between the side members and adapted to have surface engaging members affixed directly thereto such that in use the base portion is positioned proximate to the surface;

(b) an upper portion positioned above the base portion and comprising first and second opposed, longitudinally extending handle sections that define a generally open area wherein the handle sections are spaced apart so that a person using the walker frame is positioned between the generally horizontally extending handle sections, each handle section comprising a horizontal portion, a front end and a rear end; and, (c) at least one support member extending between the base portion and the upper portion, the support member configured and positioned such that part of the upper portion is cantilevered.

In one embodiment, the upper portion comprises a generally U-shaped continuous member that includes the first and second handle sections. An advantage of this design is that the construction of the device is simplified.

In another embodiment, the walker frame comprises two support members, which extend between the rear ends of the U-shaped base portion and the U-shaped upper portion.

In another embodiment, the U-shaped base portion and the U-shaped upper portion are each formed from a continuous tubular member. An advantage of this design is that the construction of the device is simplified.

In another embodiment, the base portion, the at least one support member and the upper portion are a continuous elongate member In another embodiment, the support members extend generally vertically.

In another embodiment, the support members are configured such that, in side elevation view, the base portion, a support member and the upper portion are generally U shaped.

In another embodiment, the surface engaging members comprise a plurality of peg-leg supports.

In another embodiment, the surface engaging members comprise at least one wheel affixed to the front end of the base portion and peg-legs affixed to the rear end of the base portion.

In another embodiment, the surface engaging members comprise a plurality of wheels affixed to the base portion. The plurality of wheels may comprise two rear wheels and one front wheel. In a particularly preferred embodiment, the surface engaging members comprise two rear wheels and two front wheels.

In another embodiment, the surface engaging members comprise a pair of front wheels and a pair of rear wheels, and the front wheels are rotatably mounted about a generally vertical axis.

In another embodiment, the rear wheels have a diameter that is larger than the diameter of the front wheels.

In another embodiment, the support members are positioned adjacent the rear end and the surface engaging members are affixed to the base portion rearwardly of the support member.

In another embodiment, the walker frame comprises two support members and the support members are positioned adjacent the forward end and the surface engaging members are affixed to the base portion forwardly of the support member.

In another embodiment, the rear wheels are canted inwardly. One advantage of this design is that it provides better resistance to sideways toppling should a user lean too far to one side.

In another embodiment, the walker frame further comprises rear wheels attachment members comprising generally horizontal springs, which are preferably helical or similar springs. One advantage to the use of helical spring axles is for additional suspension over bumpy or uneven surfaces. Furthermore the use of helical spring axles permits the wheel to act as an automatic brake to try to prevent a sideways fall since, as the walker starts to tip sideways, the top of the wheel will contact or rub against the walker frame, thereby resisting rotation of the wheel by friction.

In another embodiment, the base portion, the support members and the upper portion are a continuous elongate member. An advantage of this design is that the construction of the device is simplified. In the case of an arcuate or generally vertical support members at the rear end, a wheel attachment spur may be added as a rearward extension of the base portion to attach the rear wheels or other surface engaging members rearward of the point where the support member attaches to the base portion. The result of this spur is that the curved or vertical support member transfers downward force from the upper portion handle sections to the area of the base portion between the front and rear wheels, increasing stability. It will be appreciated that other means may be used to position the rear wheels rearward of rearwardly mounted support members.

In another embodiment, one support member and the first handle section are a continuous elongate member and another support member and the second handle section are also a continuous elongate member.

In another embodiment, the walker frame further comprises a carry basket mounted on at least one of the base portion and the upper portion.

In another embodiment, the walker frame further comprises a seat mounted on at least one of the base portion and the upper portion. The seat may comprise a child seat or a seat for an adult.

In another embodiment, the walker frame further comprises a plurality of skis affixed to the base portion.

In another embodiment, the walker frame further comprises a wind shield positioned at the front end of the upper portion.

In another embodiment, the walker frame further comprises a canopy, which may be a sun canopy to provide shade from the sun or a rain canopy (e.g., like an umbrella) to provide protection from rain, positioned above the open area of the upper portion. If the walker frame is provided with an optional seat, then the canopy may be positioned to provide cover for a person seated on such an optional seat. Alternately, or in addition, the walker frame may be provided with a child or baby seat, in which case a canopy may be positioned to provide cover for a child or baby seated on such an optional seat. Alternately, or in addition, the canopy may be positioned to provide cover for a user of the walker frame when the user is using the walker frame to walk.

In another embodiment, the base portion and the upper portion have a longitudinal extent sufficient to accommodate at least two people positioned longitudinally in line. An advantage of this design is that the device accommodates a second person, who may not require the use of the device. The second person may be positioned towards the rear and the infirm or disabled person positioned towards the front. Accordingly, the person in the rear may assist the infirm or disabled person to learn to use the walker.

In another embodiment wherein the support members comprise a first support member extending from the first side member of the base portion to the first handle section that is positioned above the first side member and a second support member extending from the second side member of the base portion to the second handle section that is positioned above the second side member.

In another embodiment, the walker frame is collapsible.

In another embodiment, the walker frame is disassemblable.

In another embodiment, the upper portion is height adjustable.

In another embodiment, the walker frame is configured to permit a plurality of walkers to be nested.

In another embodiment, the at least one support member is configured and positioned such that the rear end of the upper portion is cantilevered. Preferably, the support members are configured such that, in side elevation view, the base portion, a support member and the upper portion are generally U shaped.

In another embodiment, the at least one support member is configured and positioned such that the front end of the upper portion is cantilevered.

In accordance with one embodiment of the instant invention, there is provided a walker having a front end and an open rear end, the walker comprising:

(a) a generally U-shaped base portion having a front end and an open rear end and including first and second generally longitudinally extending, spaced apart, opposed side members that define a generally open area between the side members;

(b) a pair of front wheels and a pair of rear wheels affixed to the base portion, the rear wheels having a diameter that is larger than the diameter of the front wheels;

(c) a generally U-shaped upper portion having a front end and an open rear end; and, (d) support members extending between the rear end of the upper portion above the rear end of the base portion and positioned to permit unimpeded entry to the walker via the rear end of the walker.

In one embodiment, the U-shaped base portion and the U-shaped upper portion are each formed from a continuous tubular member.

In another embodiment, the support members extend generally vertically.

In another embodiment, the support members are configured such that, in side elevation view, the base portion, a support member and the upper portion are generally U shaped.

In another embodiment, the base member, the support members and the upper portion are a continuous elongate member.

In another embodiment, the walker further comprises a carry basket mounted on at least one of the base portion and the upper portion.

In another embodiment, the walker further comprises a seat mounted on at least one of the base portion and the upper portion.

In another embodiment, the front or rear end of the upper portion is cantilevered.

In another embodiment, the rear wheels are canted inwardly.

In another embodiment, the walker further comprises rear wheels attachment members comprising generally horizontal helical springs.

In accordance with another embodiment of the instant invention, a walker frame for assisting a person traveling over a surface, the walker frame comprises:

(a) a generally U-shaped base portion comprising a front end and rear end and including first and second generally longitudinally extending, spaced apart, opposed side members that define a generally open area between the side members and adapted to have surface engaging members affixed directly thereto such that in use the base portion is positioned proximate to the surface;

(b) an upper portion positioned above the base portion and comprising first and second opposed, spaced apart, longitudinally extending handle sections that define a generally open area between the horizontally extending handle sections, each handle section comprising a horizontal portion, a front end and a rear end;

(c) support members extending between the base portion and the upper portion, the support members configured and positioned such that the rear end of the upper portion is cantilevered wherein the support members are configured such that, in side elevation view, the base portion, a support member and the upper portion are generally U shaped.

One advantage of such a design is that the walker has an open rear end to permit a user to enter from the rear (e.g., by grasping the upper portion and walking or shuffling forwards, and the handgrip portion is naturally provided with a spring action due to its cantilevered configuration to absorb shocks as the walker travels over an uneven surface. This design with elongated hand-holds enables the user to walk with a more erect posture while walking. With the hands holding the handle section at the side the user is, in part, pulling the walker during operation, typically while walking slowly or stationary. With hand-holds further forward and higher, the user is pushing the walker and can have stability at higher speeds. While providing such a spring action, and erect posture during operation, the walker has a simplified construction. The use of the U shaped frame panels permits the construction of the side panels (e.g., the right side of the base section, the right side of the upper portion and a support right side support member) to be manufactured by bending or otherwise forming a continuous elongate U shaped member. Alternately, the upper portion and the base portion may be manufactured by bending or otherwise forming a continuous elongate U shaped member and the support members secured thereto. In a further alternate embodiment, the upper portion, the base portion and the support members may be manufactured by bending or otherwise forming a continuous elongate member, wherein the ends of the elongate member may be secured together (e.g., by welding) to form essentially a continuous member with no ends. These advantages are also applicable if the rear end is cantilevered (e.g., the support member or members is provided at the front end).

In accordance with another embodiment of the instant invention, a walker frame for assisting a person traveling over a surface, the walker frame comprising:

(a) a generally U-shaped base portion comprising a front end and a rear end and including first and second generally longitudinally extending, spaced apart, opposed side members that define a generally open area between the side members and adapted to have surface engaging members affixed directly thereto such that in use the base portion is positioned proximate to the surface;

(b) an upper portion positioned above the base portion and comprising first and second opposed, spaced apart, longitudinally extending handle sections that define a generally open area between the horizontally extending handle sections, each handle section comprising a horizontal portion, a front end and a rear end;

(c) support members extending between the base portion and the upper portion, wherein the support members are configured such that, in side elevation view, the base portion, a support member and the upper portion are generally U shaped.

In one embodiment, the upper portion comprises a generally U-shaped continuous member that includes the first and second handle sections.

In another embodiment, the support members extend between the front ends of the U-shaped base portion and the U-shaped upper portion.

In another embodiment, the U-shaped base portion and the U-shaped upper portion are each formed from a continuous tubular member.

In another embodiment, the base portion, the support members and the upper portion are a continuous elongate member.

In another embodiment, two support members are provided and a first support member and the first handle section are a continuous elongate member and a second support member and the second handle section are also a continuous elongate member.

In another embodiment, the walker frame further comprises at least one brace extending between the base portion and the upper portion.

In accordance with any embodiment, it will be appreciated that the walker frame may be collapsible and/or disassemblable and/or adjustable. For example, each support member may be constructed of an upper part and lower part that are moveably secured to each other. For example, the upper portion of the frame may be removably mounted to the lower portion of the frame. Alternately, the upper and lower parts of the support members may be connected by a hinge, such as is disclosed in U.S. Pat. No. 7,003,849. When the hinge is released, the upper portion may be moved downwardly to a position adjacent to the lower portion, thereby permitting the walker frame to be moved more easily (e.g., placed in the trunk of a car). Similarly, the simplicity of design allows for easy adjustment of height of the handle sections. The upper and lower parts of the support members may be connected by a locking or screw device that allows a modicum of height adjustment of the upper portion relative to the lower portion, similar to that for bicycle seat height adjustments. The simple frame construction of the instant invention, which uses preferably only two generally vertical support members, allows easy height adjustment using only two devices, one in each support member. For example, each support member may comprise an upper element and a lower element wherein the upper element is telescopically moveable in the lower element.

In accordance with any embodiment, the walker may be configured to permit a plurality of walkers to be nested.

BRIEF DESCRIPTION OF THE DRAWINGS

These and other advantages of the instant design will be more fully and completely understood in accordance with the following description of the preferred embodiments of the invention in which.

DETAILED DESCRIPTION OF THE INVENTION

Figure 1:
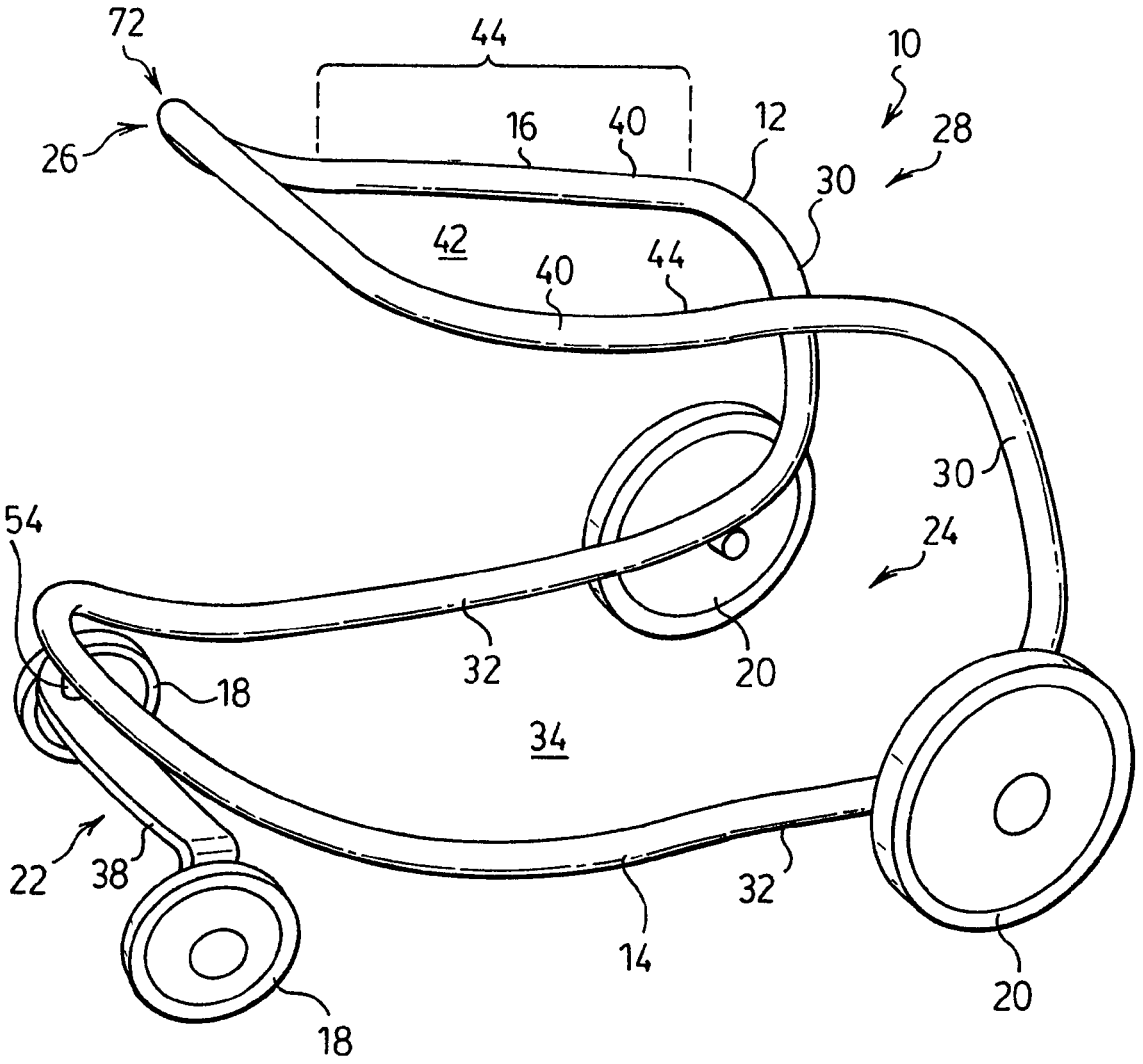
FIG. 1 is a perspective view of a walker according to a first embodiment of this invention.

Referring to FIGS. 1-4, walker 10 comprises walker frame 12, which comprises base or lower portion 14 and upper portion 16. In this preferred embodiment, base portion has directly mounted thereto a pair of front wheels 18 and a pair of rear wheels 20. Base portion has a front end 22 and a rear end 24. Similarly, upper portion 16 has a front end 26 and a rear end 28. Upper portion 16 is secured above base portion 14 by first and second support members 30.

Figure 4:
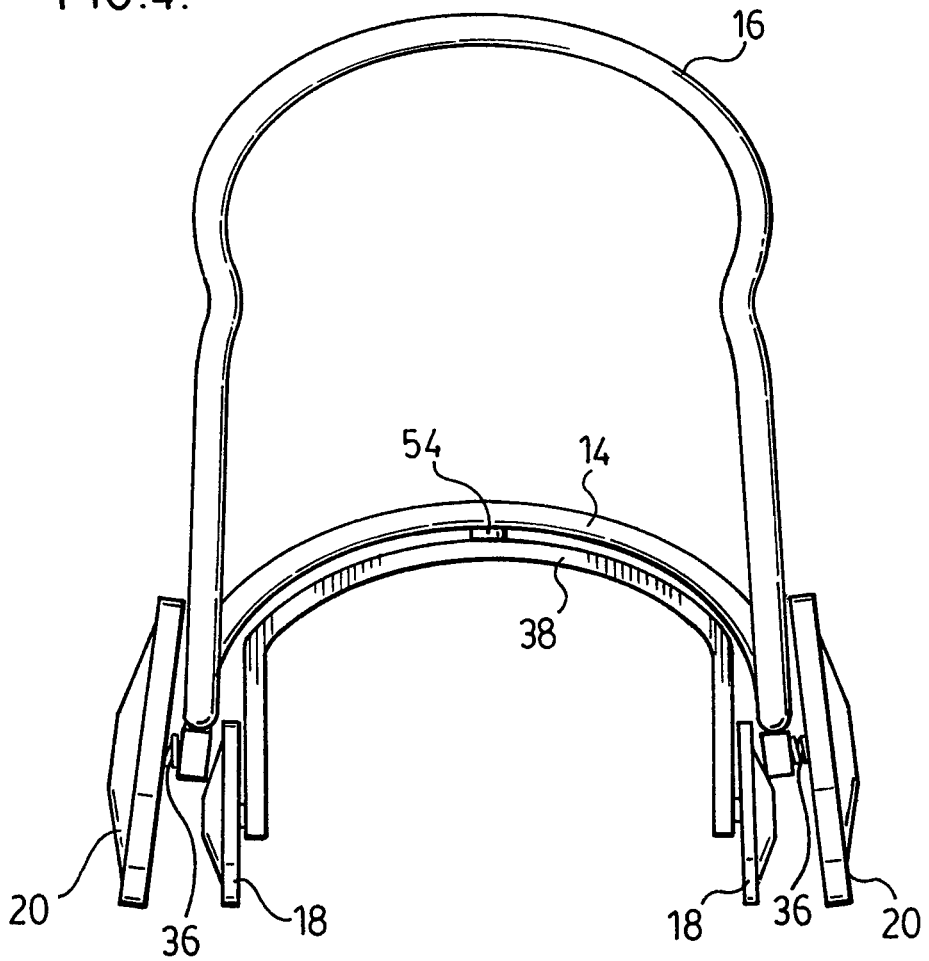
FIG. 4 is a rear view of the walker of FIG. 1, wherein the spring axles have been bent to show how the wheels rub against the frame and act as an anti-tipping brake.

Base portion 14 is generally U-shaped and has first and second generally longitudinally extending, spaced apart, opposed side members 32 which define a generally open area 34 therebetween. Base portion 14 is adapted to have surface engaging members, such as wheels 18, 20, affixed directly thereto. For example, as shown in FIGS. 1, rear wheels 20 are affixed directly to rear end 24 of base portion 14 or to a spur or extension 76 of the base portion 14 as exemplified in FIGS. 12 and 13, by, e.g. horizontally extending helical springs 36. Helical springs 36 may be secured to frame 12 by any means known in the art (such as by a bushing or welds on the frame 12 and bushings in the wheel hub). Optionally, as shown in FIG. 4, rear wheels 20 may be canted inwardly. An advantage of canting the rear wheels inwardly is increased lateral stability to help prevent the user falling sideways. The benefits of helical springs 36 are improved suspension over rough surfaces, and to allow the canted rear wheels 20 to angle further inward during lateral pressure, caused for example by a user leaning too far sideways, to act as a natural anti-tipping brake for that wheel when the top of the wheel rubs against the walker frame at the support member 30 or side member 32, resisting additional rotation of the wheel.

Front wheels 18 are connected directly to front end 22 of base portion 14 by U-shaped suspension bar 38. Bar 38 may be pivotally mounted to front end 22 by pivot pin 54 (see FIG. 4). Alternately, or in addition, front wheels 18 may be rotatably mounted to bar 38. For example, front wheels 18 may be casters. Alternately, front wheels 18 may be secured to axles attached, e.g., to side members 32.

As used herein, the word "directly" means that the wheels are attached to base portion 14 (whether by an intermediary member such as bar 38) such that base portion 14 is positioned proximate to the surface over which walker 10 travels. For example, base portion 14 is mounted at about the height of the wheels and not substantially thereabove, such as in the case of Moller. Preferably, the base portion 14 is positioned from about 1 to about 12 inches and preferably from about 2 to about 6 inches above the ground. An advantage of this design is that the likelihood of walker 10 tipping to one side is reduced. For indoor use on smooth surfaces, the walker may have smaller wheels and the base portion 14 may be closer to the ground, whereas for outdoor use, where obstacles are present, the wheels are preferably larger and the base portion 14 further off the ground.

Upper portion 16 comprises first and second opposed, spaced apart longitudinally extending handle sections 40 that define the generally open area 42. Handle sections 40 include a generally horizontal side portion 44 that may be grasped by a user when the arms of the user are at the side of the user (see for example FIGS. 1 and 2) and a more elevated front handle portion 72 that may be grasped by a user when the arms of the user are extended forwardly, such as when the user is moving faster or even running.

In use, a person may enter walker 10 from the rear. As they enter walker 10, they preferably position themselves between horizontal portions 44 and place their hands on horizontal portions 44 and move forward to a desired position within walker 10. Thus their hands may extend outwardly or outwardly and forwardly to provide support. Due to generally open areas 34 and 42, the interior of the walker is generally open permitting the person to essentially be surrounded by walker 10 and not to merely be holding handle bars positioned in front of them. As may be required, the person may position themselves towards front end 26 or towards rear end 28 as may be desired. As horizontal portions 44 have a longitudinal extent (preferably about 16 to 24 inches if upper portion extends longitudinally for about 24-40 inches), (longer for double person use, and shorter for child use), the user has a relatively large area in which they may place their hands and still have their hands at an ergonomic height to assist them while traveling. If the user prefers, the forearms can be rested on the handle sections and used to push the walker instead of the hands, in which case the handle section 44 will be higher (e.g., 30" to 50") from the ground surface. Accordingly, in one embodiment, it is preferred that the height of horizontal portions 44 is adjustable, such as by varying the height of base portion 14 from the ground and/or varying the height of upper portion 16 with respect to base portion 14. Accordingly, support members 30 may be constructed of two portions wherein one portion is telescopically receivable in the other portion and lockable in two or more positions, representing two or more heights.

Figure 10:
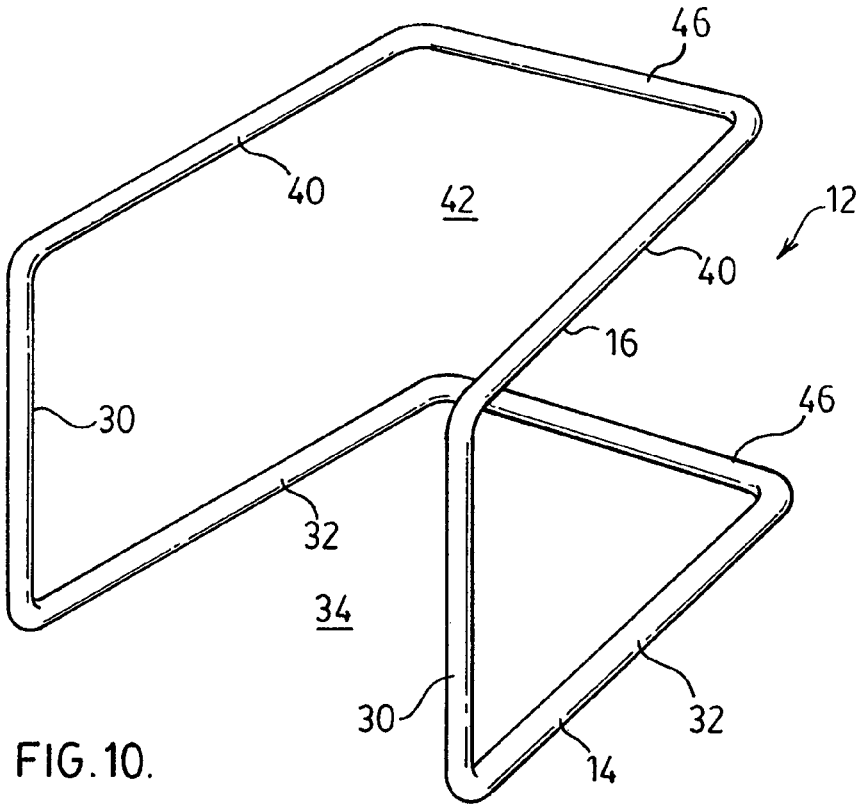
FIG. 10 is a perspective view from the rear of an alternate construction of a frame for a walker in accordance with the instant invention; and, FIG. 11 is a perspective view from the rear of a further alternate construction of a frame for a walker in accordance with the instant invention.
Figure 11:
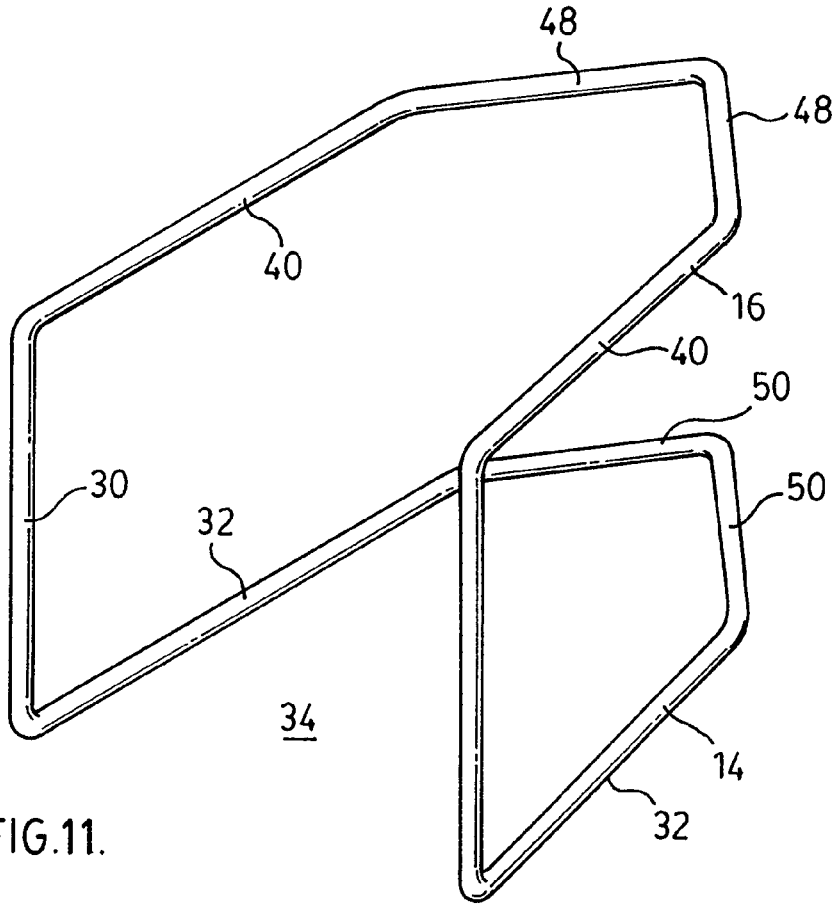
Figure 12:
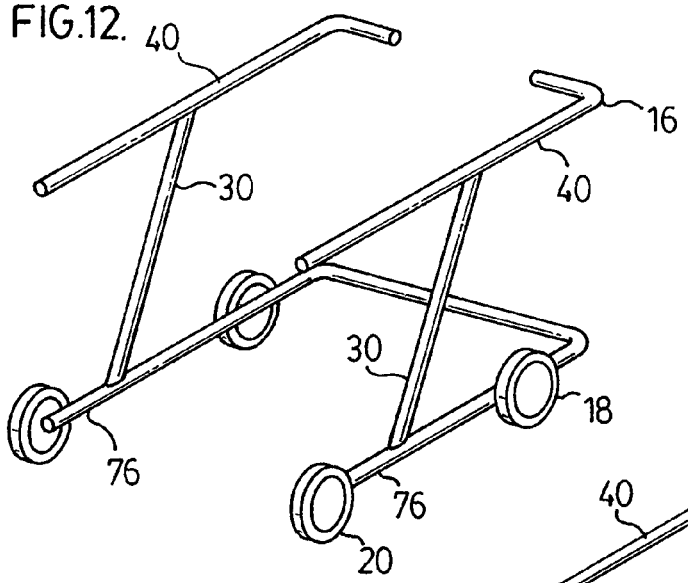
FIG. 12 is a perspective view from the rear of a further alternate construction of a frame for a walker in accordance with the instant invention.

As exemplified in FIG. 1, each of upper and lower portions 14, 16 may be constructed from a generally continuous member (e.g. hollow tubing, which is preferably oval in cross-section). However, as exemplified in FIG. 10 and 11, portions 14 and 16 may be constructed from individual members that may be secured together (e.g. individual pieces of tubing which are welded together). For example, as shown in FIG. 10, each of upper and lower portions 14 and 16 are provided with a straight front cross-member 46. Accordingly, portions 14 and 16 and cross-member 46 may be formed from a bent pipe. Alternately, each of portions 14 and 16 and cross-member 46 may be separate pipes that are secured together by rivets or welding or securing sleeves or the like. Alternately, upper portion 16 and lower portion 14 may each be prepared from a combination of formed (e.g., bent) pipes and welded pipes. Alternately, as shown in FIG. 11, the front ends of handle sections 40 are connected by two inwardly angled members 48 so as to have a prow. Similarly, the front ends of side members 32 of base portion 14 are connected together by a pair of inwardly angled members 50. Alternately, as shown in FIG. 12, the front ends of handle sections 40 are not connected. In each of these additional alternate embodiments, the straight sections may be individual pipes. The upper portion and the lower portion may be two or more members that are secured together or shaped and then secured together, or one continuous member that is formed into the desired shape. In all such cases, a generally opened U-shaped area is provided for receiving a user.

Figure 2:
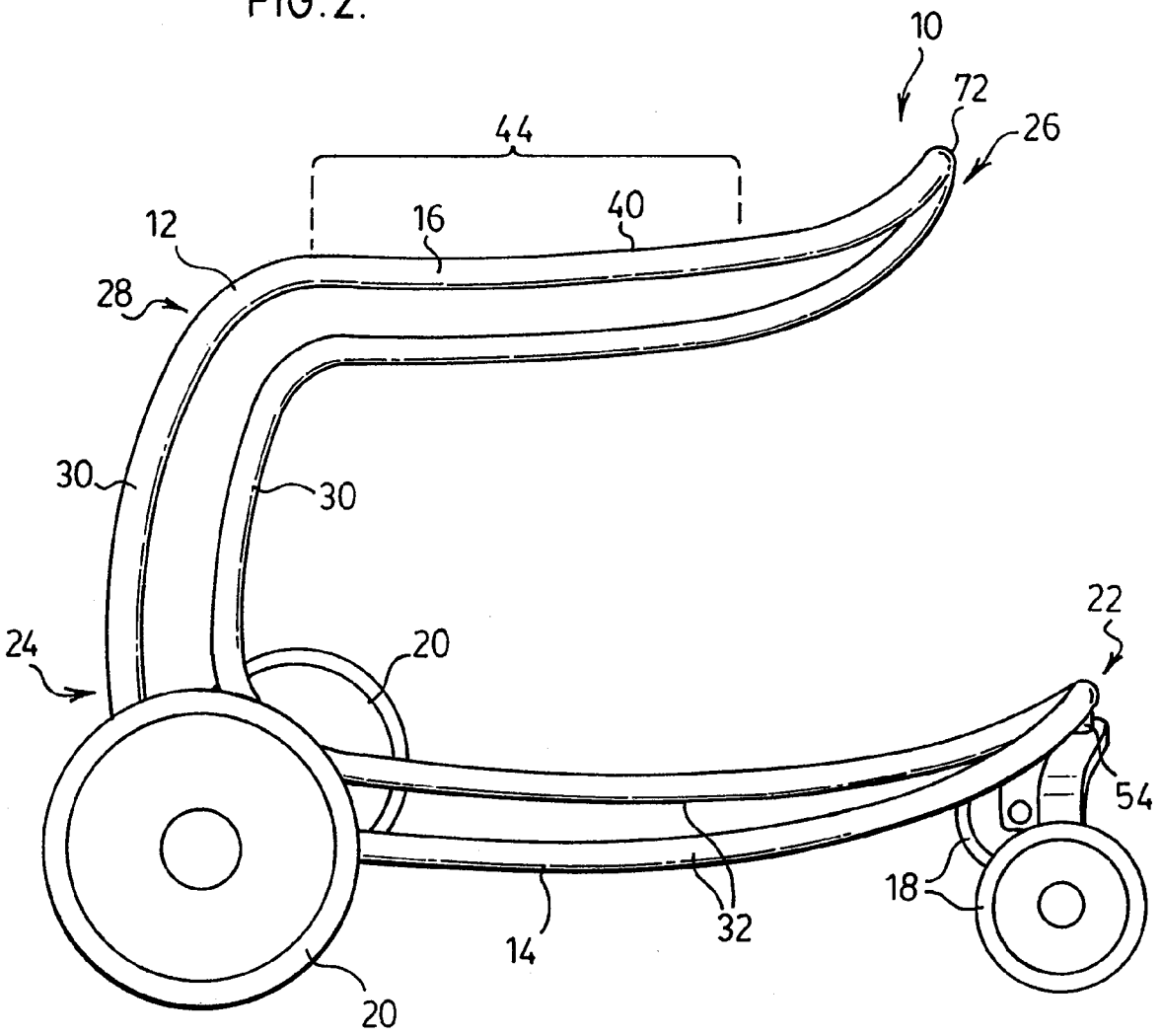
FIG. 2 is a side view of the walker of FIG. 1.
Figure 3:
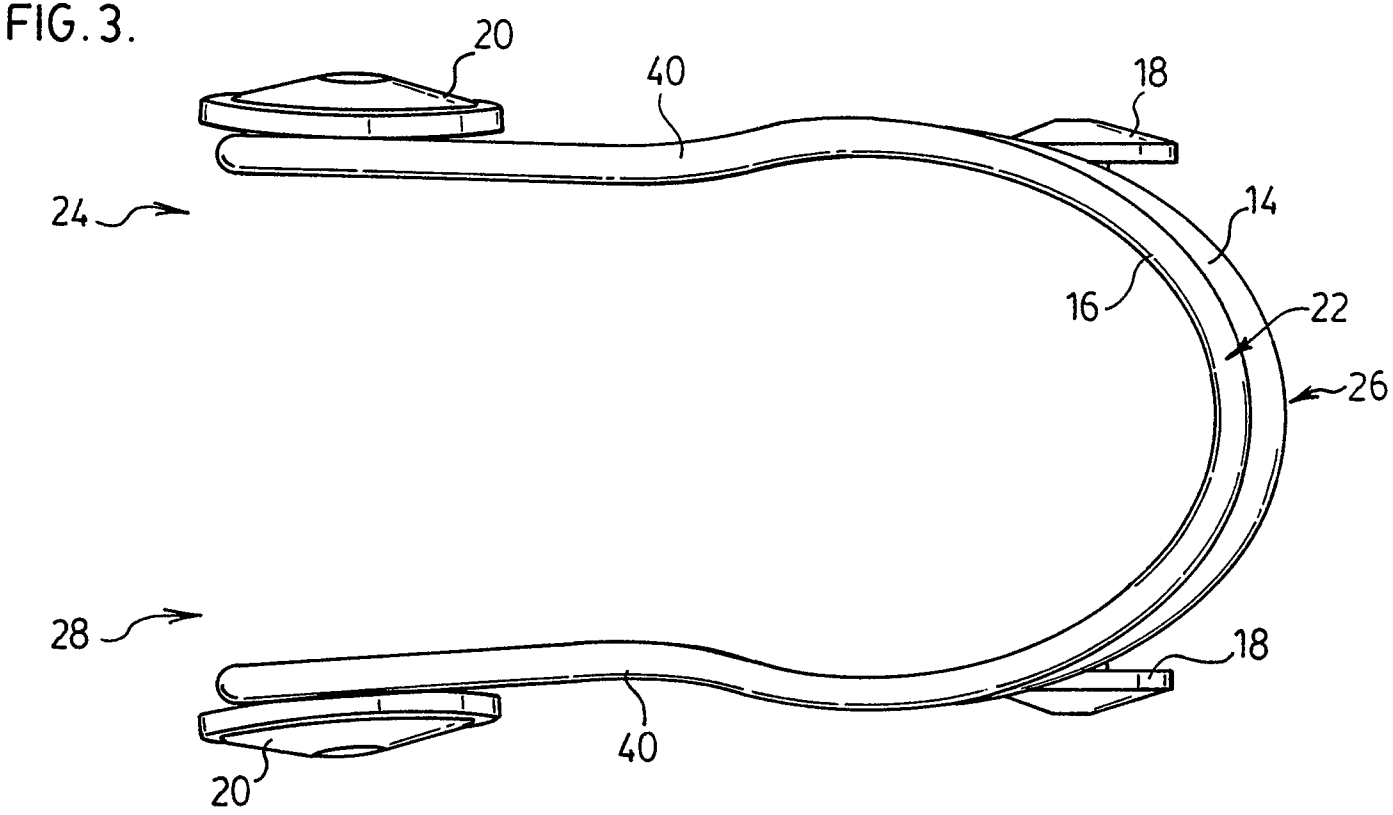
FIG. 3 is a top plan view of the walker of FIG. 1.
Figure 13:
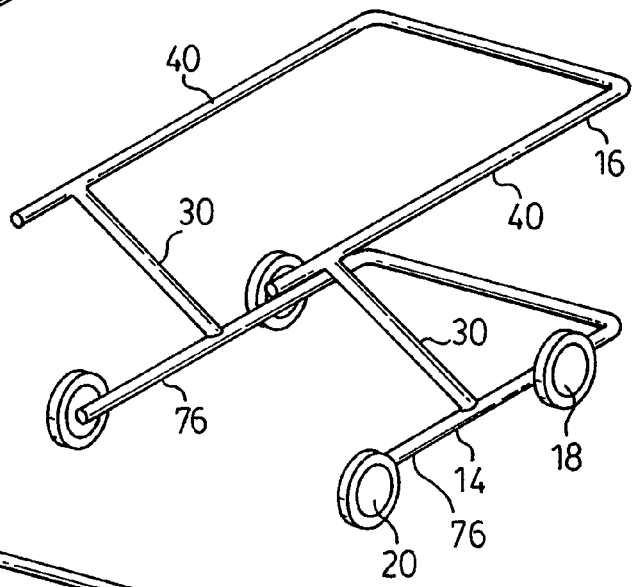
FIG. 13 is a perspective view from the rear of a further alternate construction of a frame for a walker in accordance with the instant invention.
Figure 14:
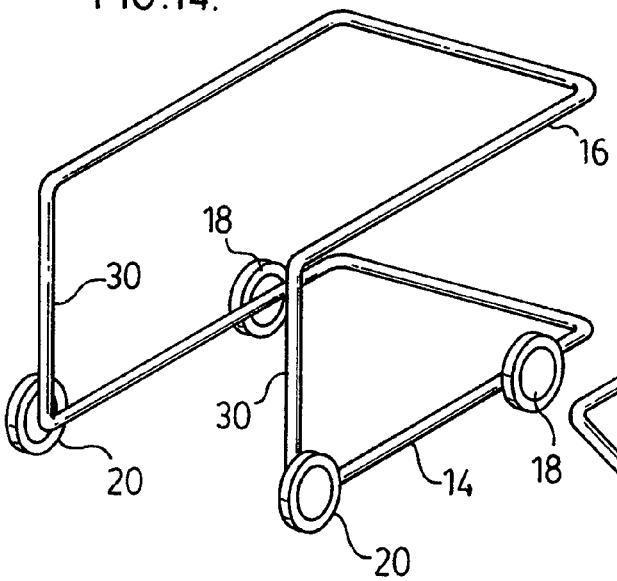
FIG. 14 is a perspective view from the rear of a further alternate construction of a frame for a walker in accordance with the instant invention.

Support members 30 preferably extend between the rear end of handle sections 40 and the rear end of base portion 14. Accordingly, all of handle sections 40 are cantilevered outwardly from support members 30. In addition, it is preferred that support members 30 are generally vertical. As shown in FIGS. 10, 11 and 14, support members 30 extend vertically. As shown in the embodiment of FIG. 2, for example, support members 30 are generally arcuate in shape so as to provide a curved section where they merge with handle sections 40 and side members 32. It will be appreciated that support members 30 may extend upwardly at an angle. In such a case, it is preferred that the angle is within 45 degrees of the vertical so as to provide the required longitudinal extent of horizontal portions 44. For example, as shown in FIG. 13, support members 30 extend upwardly and rearwardly.

Figure 15:
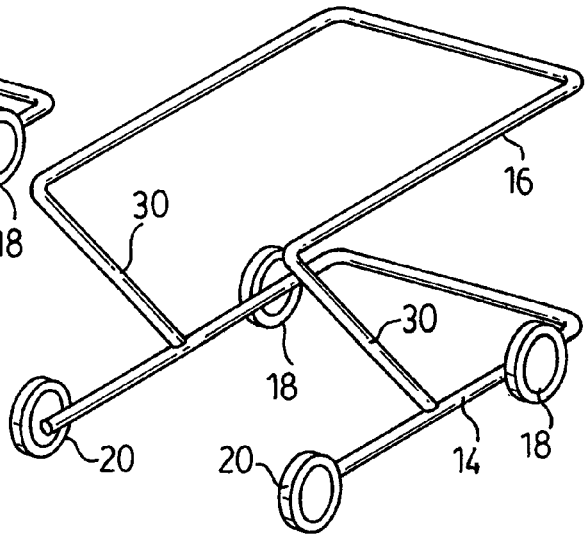
FIG. 15 is a perspective view from the rear of a further alternate construction of a frame for a walker in accordance with the instant invention.
Figure 23:
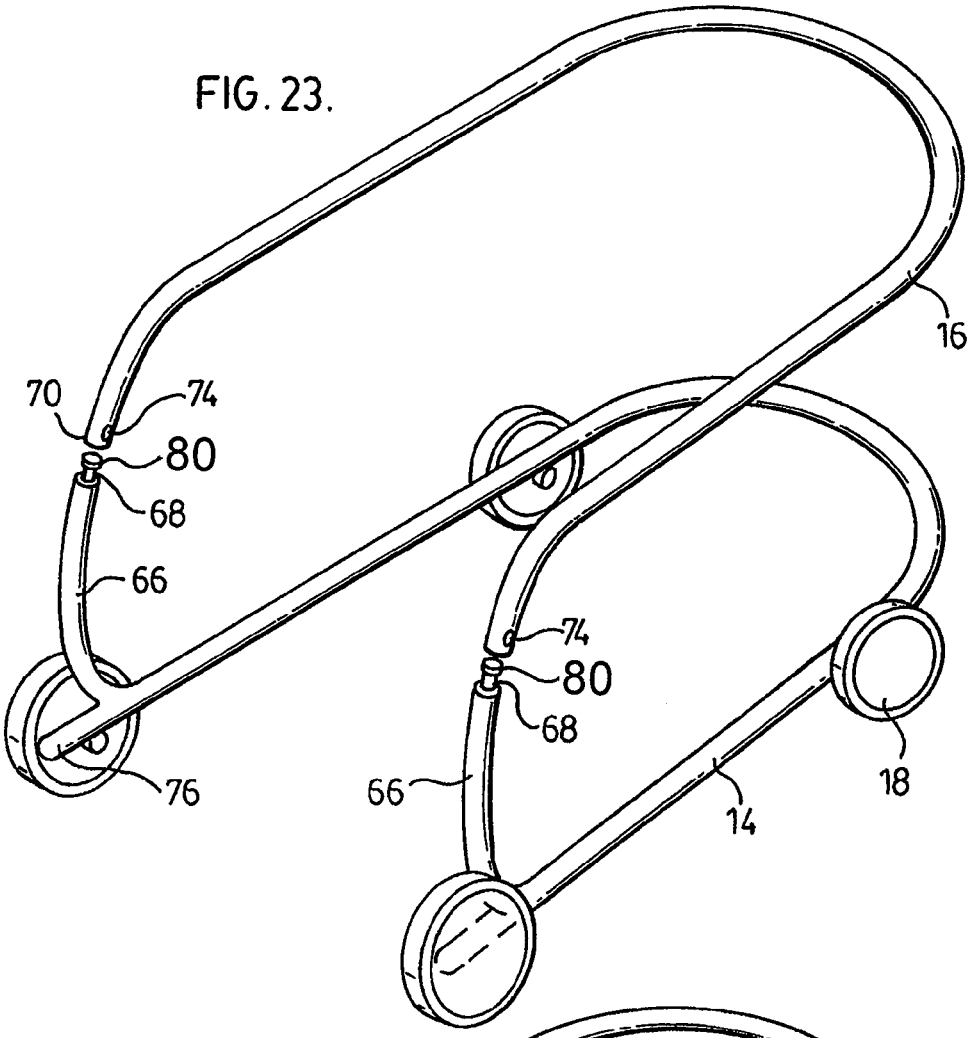
FIG. 23 is a perspective view from the rear of a further alternate construction of a frame for a walker in accordance with the instant invention wherein the frame is disassemblable.
Figure 24:
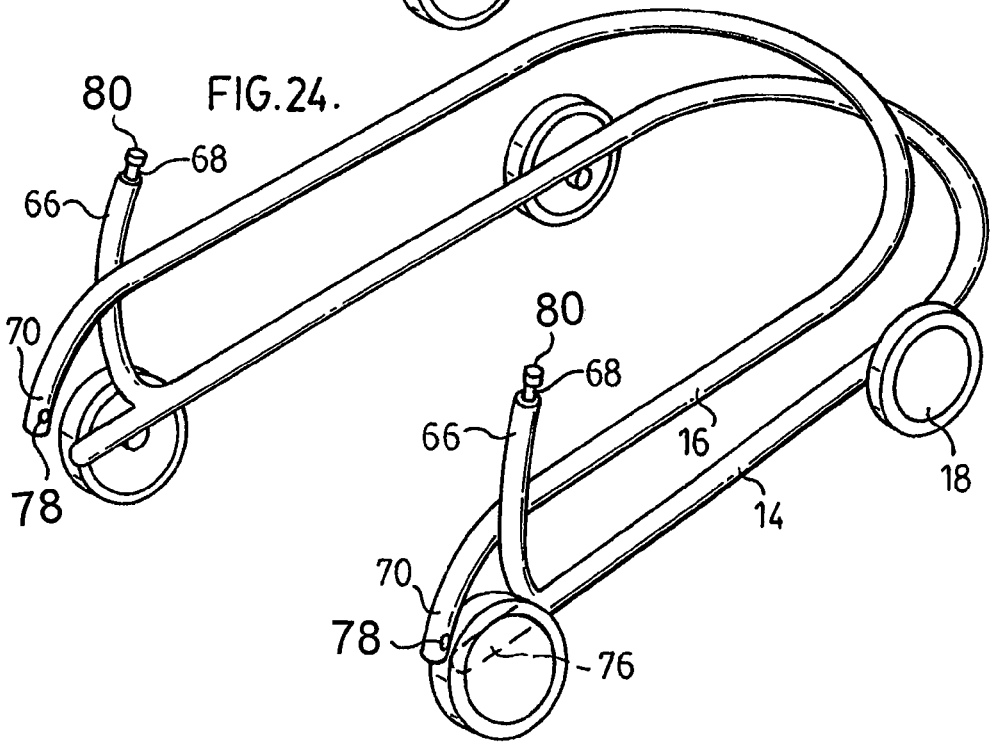
FIG. 24 is a perspective view from the rear of the further alternate construction of FIG. 23 wherein the frame has been disassembled.

Support members may be mounted at any location on base portion 14. For example, as shown in FIG. 15, support members are positioned between front wheels 18 and rear wheels 20. As shown in FIG. 14, support members are provided at the rear end of base portion 14. As shown in FIG. 13, support members 30 are provided adjacent front end 22 and preferably rearwardly of front wheels 18. For increased stability during use, and in cases where support members 30 are attached at the rear or front ends of lower portion 14 at or very near the rear wheels 20 or front wheels 18 or other surface engaging members, a rearward or forward extension 76 or spur of lower portion 14 may be used to attach the wheels, or the like, so that the support members 30 attach to the lower portion 14 between the front and rear surface engaging members, and not outside them. FIG. 12 shows such an extension 76 rearward of the point where support member 30 attaches to lower portion 14, forward of rear wheel 20, resulting in a more stable platform. See also FIGS. 5, 23 and 24 wherein an extension 76 is utilized to position rear wheels 20 outwardly of support members 30.

In a particularly preferred embodiment, as exemplified in FIGS. 2 and 14, support members 30, base portion 14 and upper portion 16 are configured so as to be generally U-shaped in side elevation view. Accordingly, support members 30 extend from the rear of base portion 14 to the rear of upper portion 16.

Figure 17:
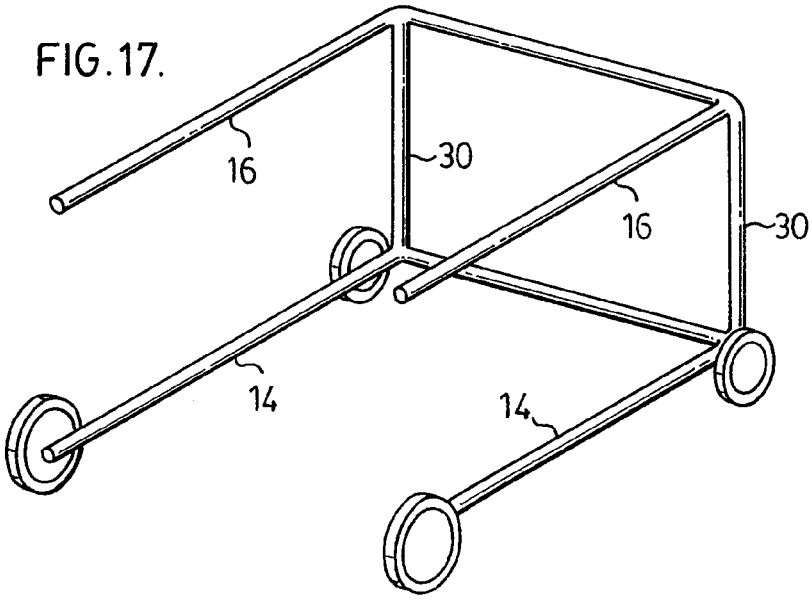
FIG. 17 is a perspective view from the rear of a further alternate construction of a frame for a walker in accordance with the instant invention wherein the rear ends of the handgrip portions are cantilevered.

In an alternate embodiment, which is exemplified in FIG. 17, support members 30 extend from the front of base portion 14 to the front of upper portion 16. In accordance with this alternate embodiment, the rear ends of support members 30 are cantilevered instead of the front ends. It will be appreciated that support members 30 may extend upwardly at an angle. Alternately, or in addition, it will be appreciated that support members may be mounted at any location on base portion 14. Preferably, if the rear ends of upper portion 16 are cantilevered such as exemplified in FIG. 17, then support members 30 are positioned at the front ends of base portion 14 and upper portion 16 such that support members 30, base portion 14 and upper portion 16 are configured so as to be generally U-shaped in side elevation view. It will be appreciated that in the embodiments of FIGS. 1 and 17, support members 30 are positioned at a distal end, either the front or the rear end, of frame 10.

In accordance with another construction technique that may be used, if support members 30, base portion 14 and upper portion 16 are configured so as to be generally U-shaped in side elevation view, then each side of the walker frame may be constructed from a single continuous elongate member that is formed into the desired shape, and the two sides secured together, such as by cross members 46, 48. For example, the right side of upper portion 16 of the walker frame and the right side of the base portion 14 of the walker frame and the support member extending between the right side portions may be a continuous generally U-shaped member that defines a right side panel. Similarly, the left side of upper portion 16 of the walker frame and the left side of the base portion 14 of the walker frame and the support member extending between the left side portions may be so formed and define a left side panel. Each side panel may then be secured together.

Figure 18:
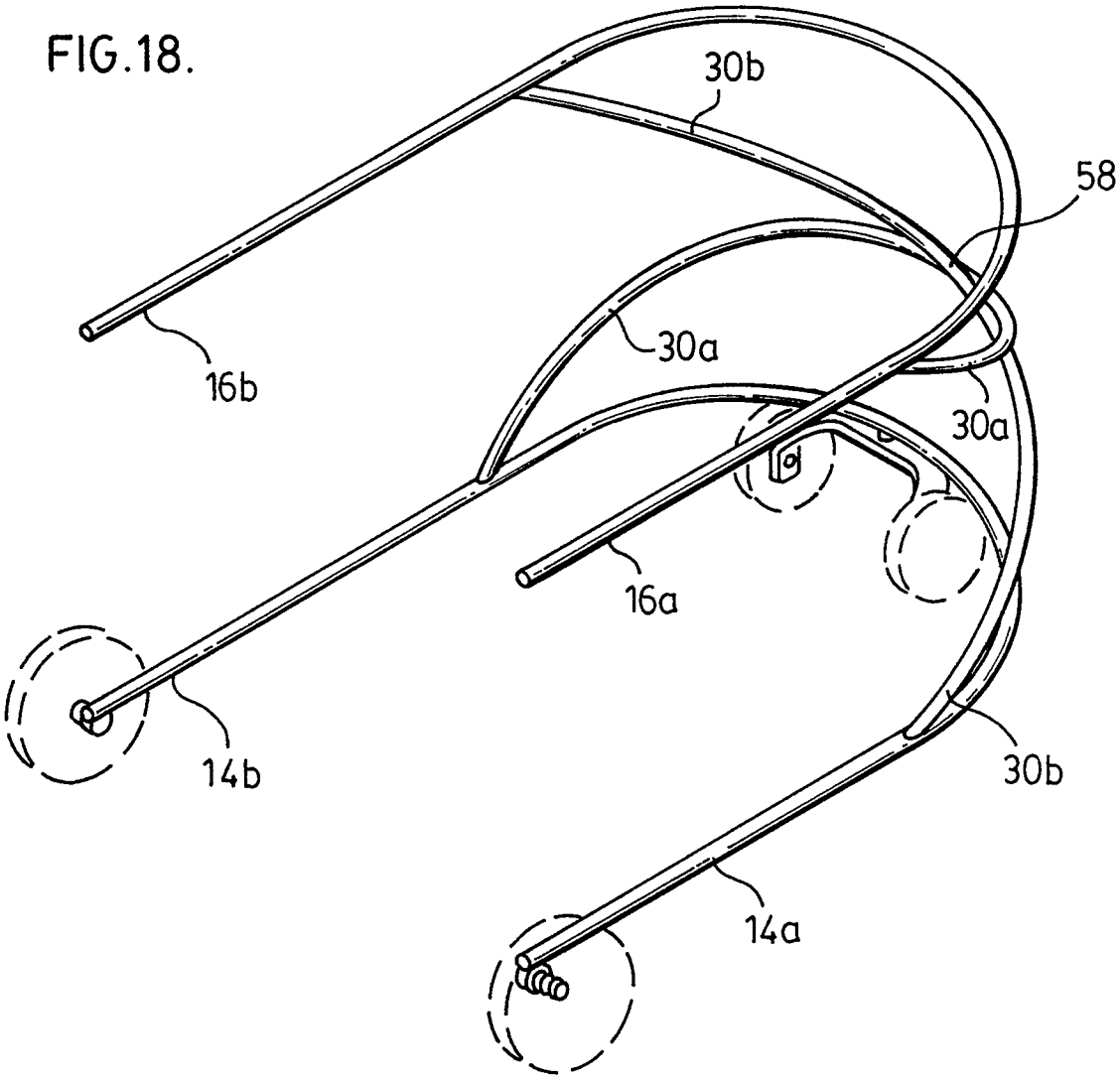
FIG. 18 is a perspective view from the rear of a further alternate construction of a frame for a walker in accordance with the instant invention wherein the support members are secured to each other.

In accordance with another embodiment, the securing members may be cross-braced or secured to each other to increase the rigidity of walker frame 12. For example, referring to FIG. 18, support member 30*a* extends from left side base portion 14b to right side upper portion 16*a* and support member 30*b* extends from right side base portion 14*a* to left side upper portion 16*b*. Support members 30*a* and 30*b* may be joined or secured together at point 58, thereby increasing the strength of walker frame 12.

In the exemplified constructions, walker 10 has four wheels. In alternate constructions, it will be appreciated that walker 10 may be provided with a single front wheel. In addition, walker 10 may be provided with more than four wheels.

Preferably, rear wheels 20 have a larger diameter than the diameter of front wheel 18. For example, rear wheel 20 may have a diameter that is from 1 to 4 times the diameter of front wheel 18 and preferably from 2 to 4 times. Preferably, front wheels 18 have a diameter of at least 3.

Figure 5:
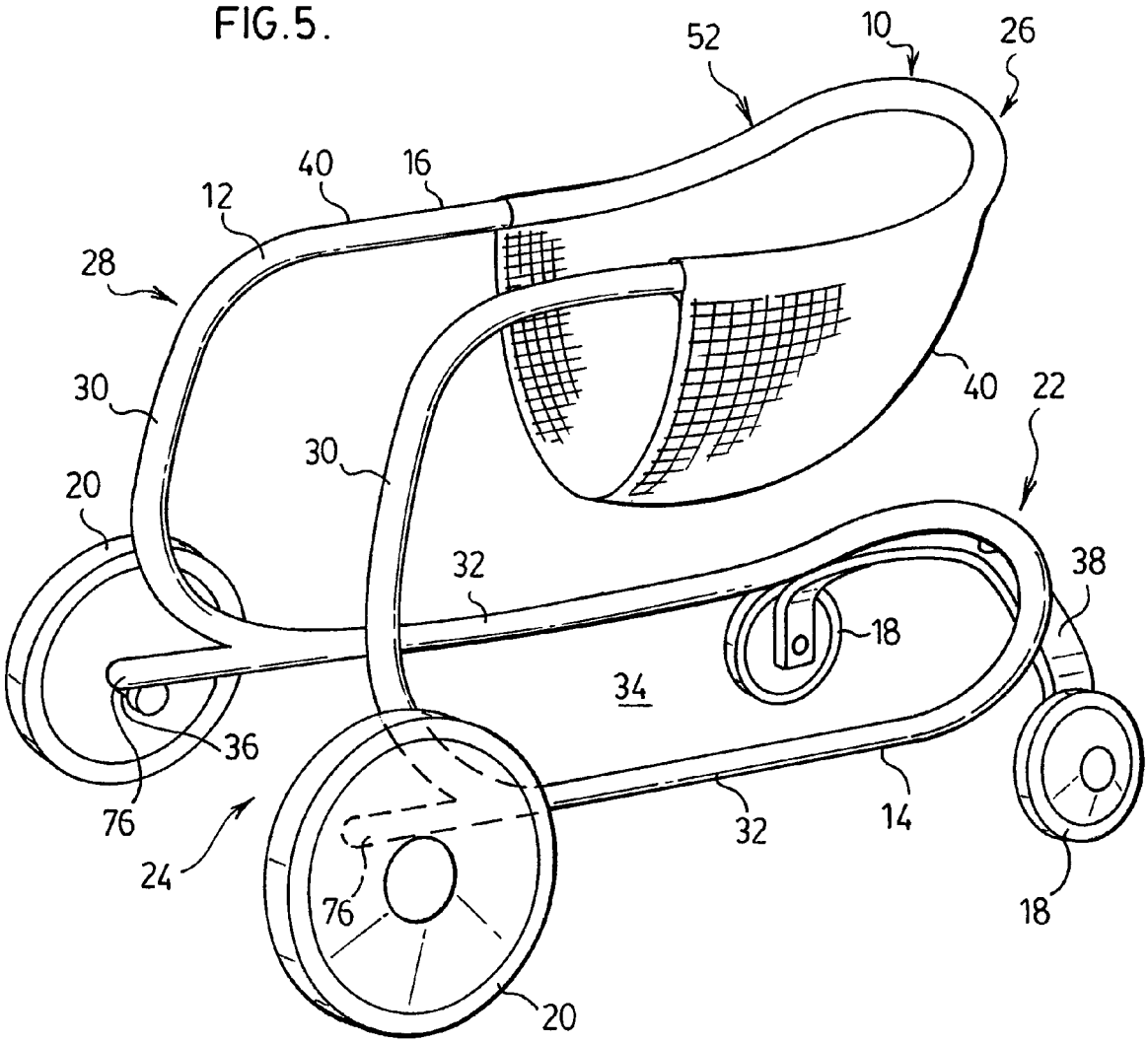
FIG. 5 is a perspective view from the rear of a second embodiment of a walker according to the instant invention.
Figure 6:
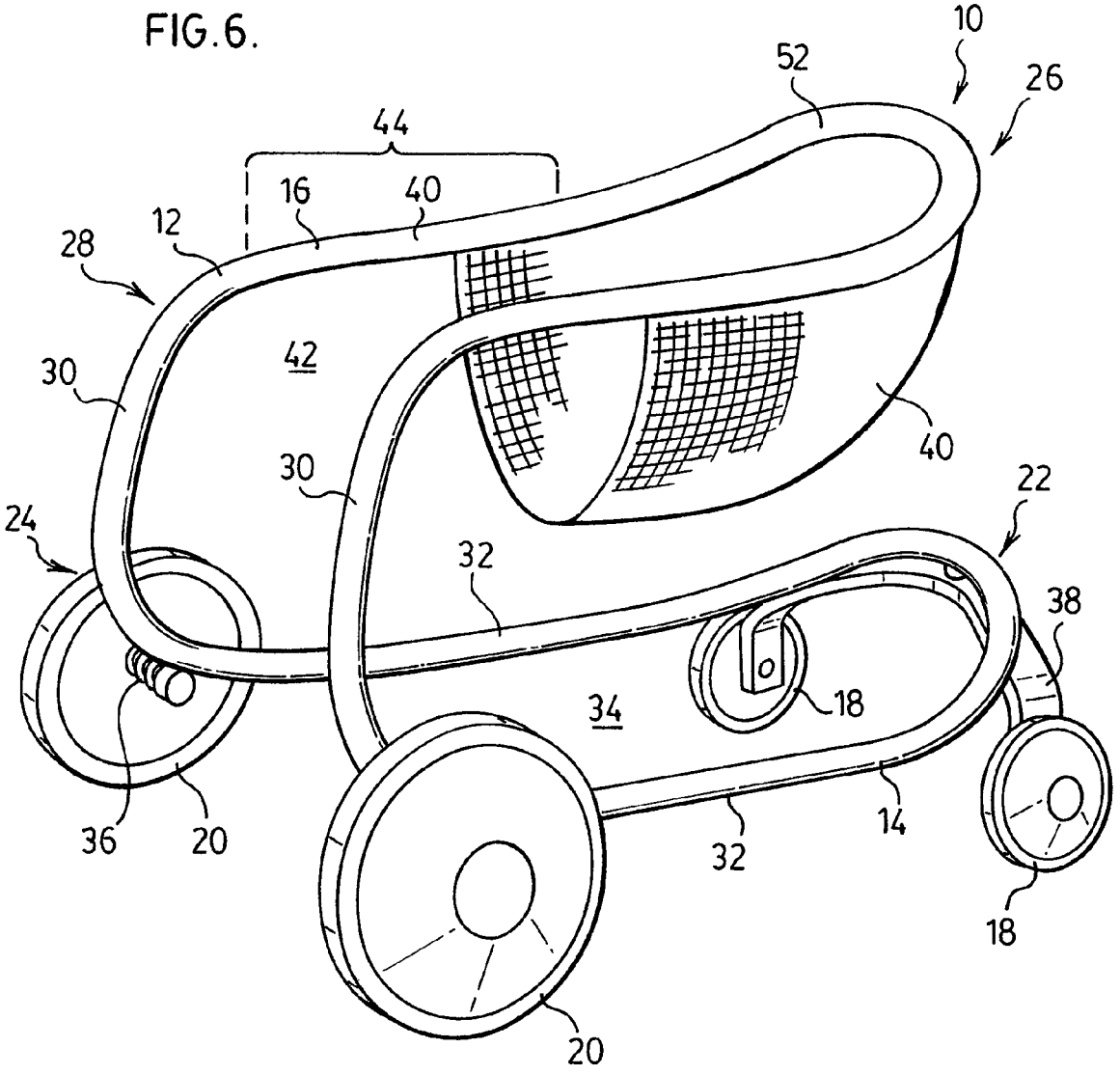
FIG. 6 is a perspective view from the side the walker of FIG. 5.

As exemplified in FIGS. 5 and 6, walker 10 may be provided with a seat for use when stationary or for emergency use as a temporary wheelchair. Seat 52 may be flexible material (e.g. a woven canvas or mesh material) that is secured around front end 26. The cantilevered frame design enables this type of light-weight sacking, which is easily rolled up and carried, to be pulled over the framework to provide stable seating. Accordingly, a user may face rearwardly and be securely seated in walker 10.

Figure 7:
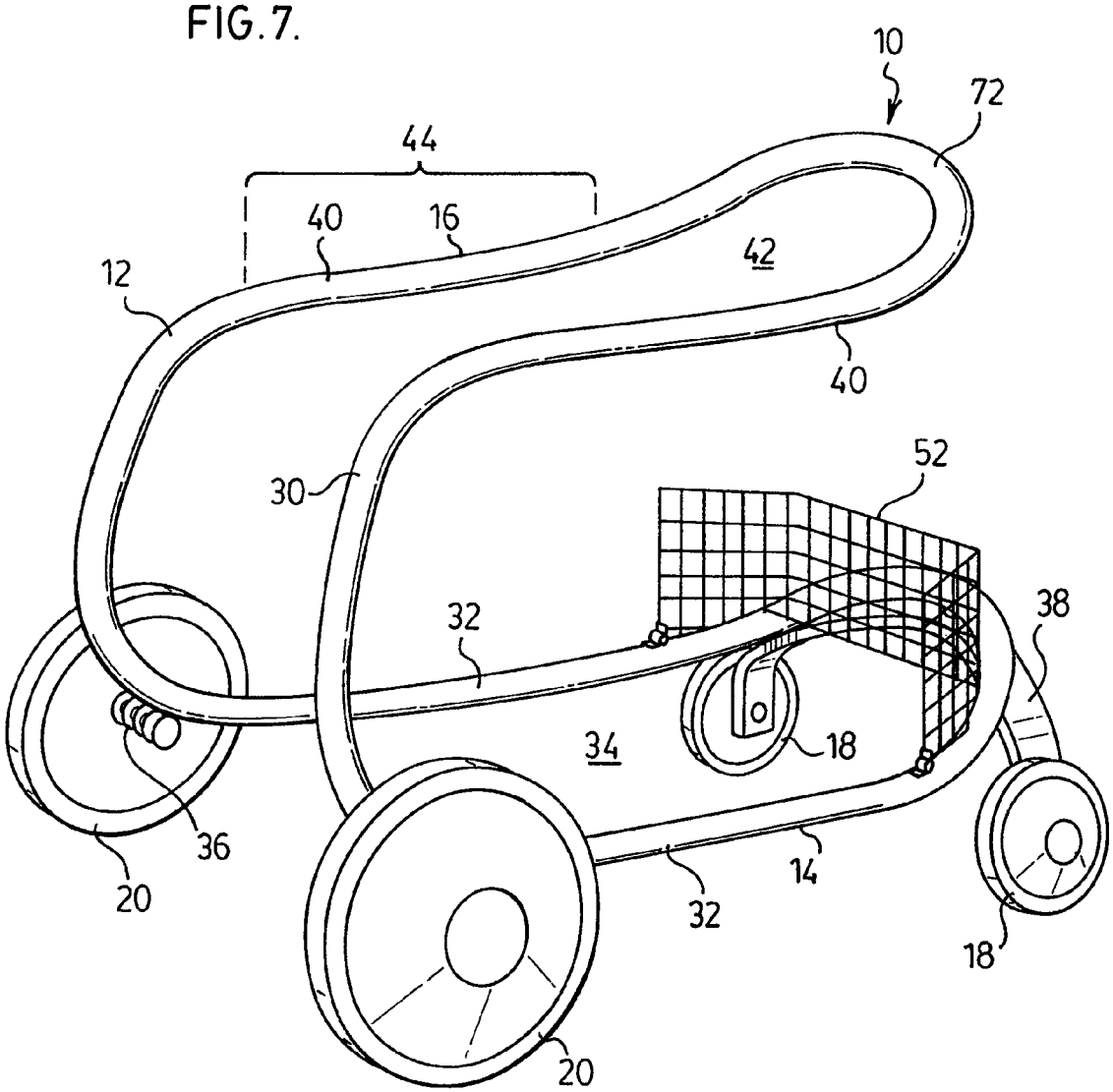
FIG. 7 is a perspective view from the rear of a third embodiment of a walker according to the instant invention.
Figure 8:
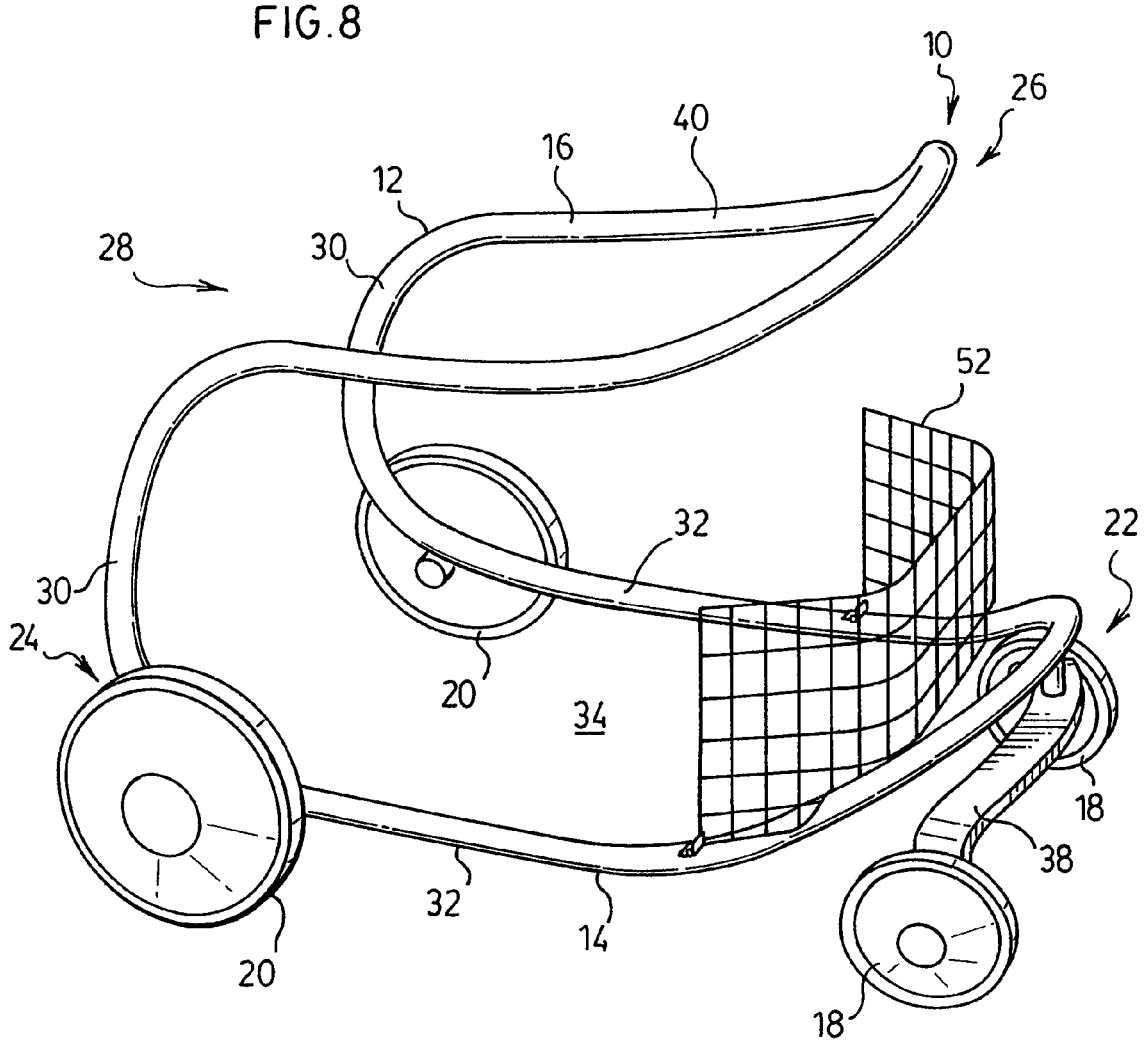
FIG. 8 is a perspective view of the side of the walker of FIG. 7.
Figure 9:
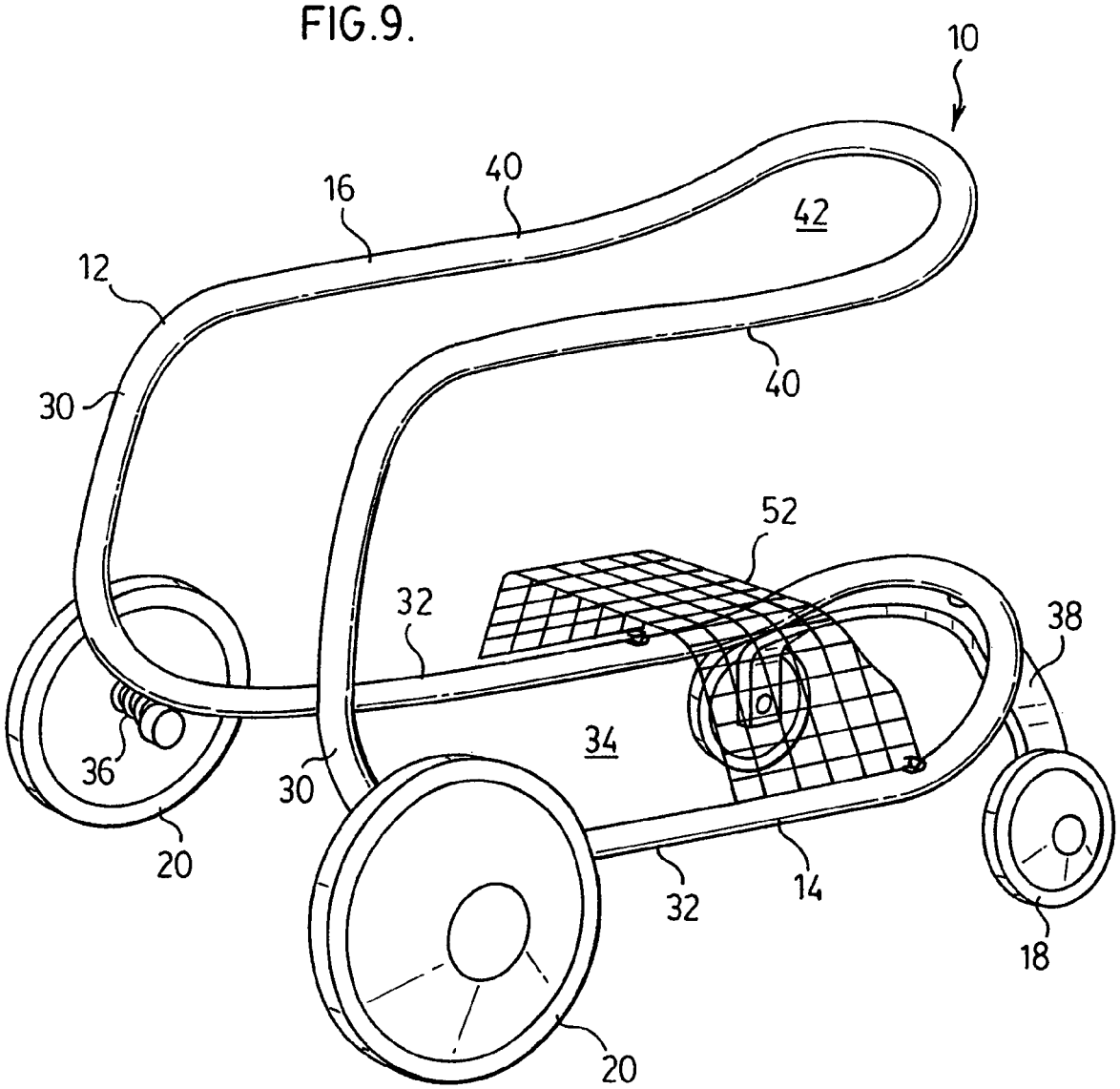
FIG. 9 is a perspective view from the side of an alternate configuration of the walker of FIG. 7.

Alternately, a seat 52 may be secured to a base portion 14 (see for example FIGS. 7-9). Seat 52 may be pivotally mounted from a first position shown in FIGS. 7 and 8 (the walking configuration) to the second position shown in FIG. 9 (the seated configuration). In such an embodiment, seat 52 is preferably constructed from a rigid material (e.g. a rigid wire mesh). In order to ensure seat 52 does not impede a person when using the walker to walk, seat 52 is pivoted so as to leave area 34 generally open when the walker is in use as a walker. When the walker is to be used to provide a seat, seat 52 may then be moved to the position shown in FIGS. 9 and 16.

In any embodiment, walker 10 may be provided with a carry basket. The carry basket may be secured to base portion 14 and/or upper portion 16.

In any embodiment, walker 10 may be provided with a wind shield. The wind shield may be secured to base portion 14 and/or upper portion 16.

Figure 16:
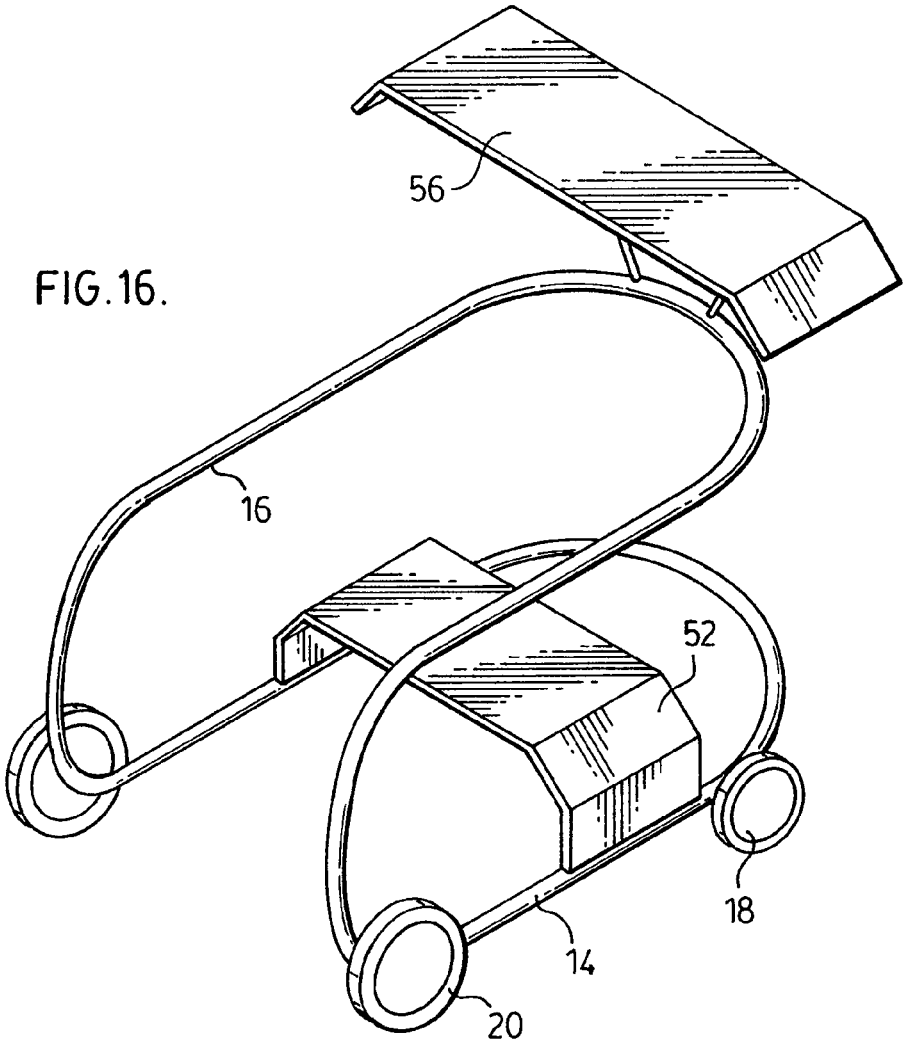
FIG. 16 is a perspective view from the rear of a further alternate construction of a frame for a walker in accordance with the instant invention wherein an optional canopy and an optional seat are provided.

In any embodiment, walker 10 may be provided with a canopy 56. The canopy may be secured to base portion 14 and/or upper portion 16. An example is shown in FIG. 16 wherein canopy 56 is positioned to provide protection for a person seated on optional seat 52.

In accordance with a further alternate embodiment, one or more braces may be provided to increase the rigidity of walker frame 12. The cantilevered construction of the support member may be difficult for use with very heavy people leaning on it for support, or when an adult chair is supplied suspended from the upper portion and overly weighted. In these cases, U-shaped support members 30 may be overly stressed without structural reinforcement of the U-shaped support members, or the provision of one or more additional braces 74

Figure 19:
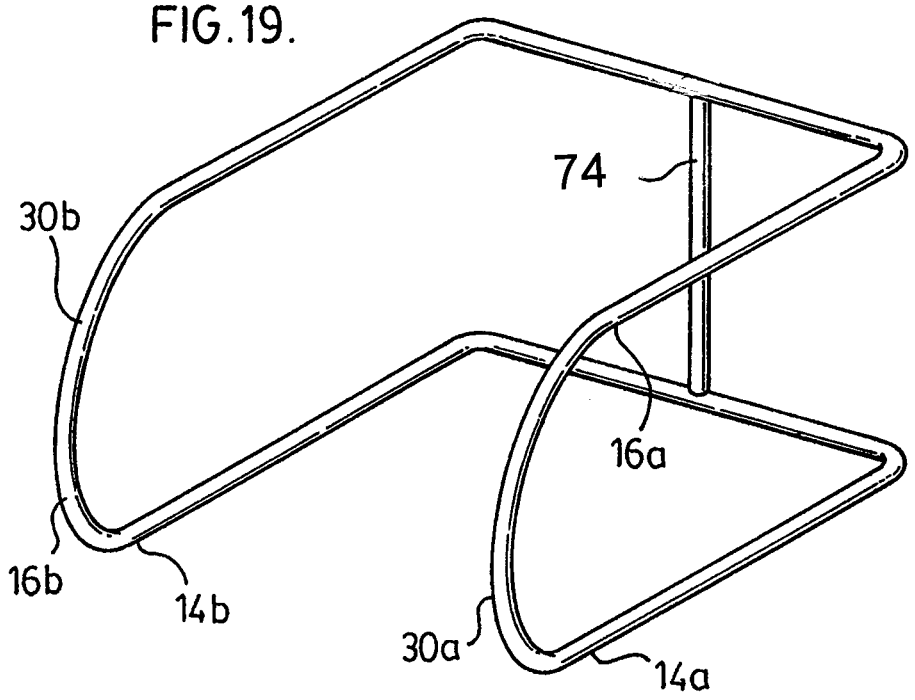
FIG. 19 is a perspective view from the rear of a further alternate construction of a frame for a walker in accordance with the instant invention wherein the frame is braced.

For example, as exemplified in FIG. 19, a central brace 74 may be provided between the front ends of the upper and lower portions 16, 14. Alternately, as exemplified in FIG. 20, a left brace 74*b* may be provided between the left side 16*b* of the upper portion 16 and the left side 14*b* of the lower portion 14 and a right brace 74*a* may be provided between the right side 16*a* of the upper portion 16 and the right side 14*a* of the lower portion 14. Such a construction may be preferred if the walker will be used on a smooth surface (e.g., indoor use such as in a retirement home or a hospital or the like) or for additional support for heavy users. In accordance with this construction, frame 12 is constructed with an open rear and defines a generally U-shaped enclosure. The upper portion and/or the lower portion are constructed from continuous elongate members or the side panels are constructed from continuous elongate members. While such braces reinforce the walker frame, the addition of such braces substantially reduces the spring effect of the cantilever design during normal use.

Figure 20:
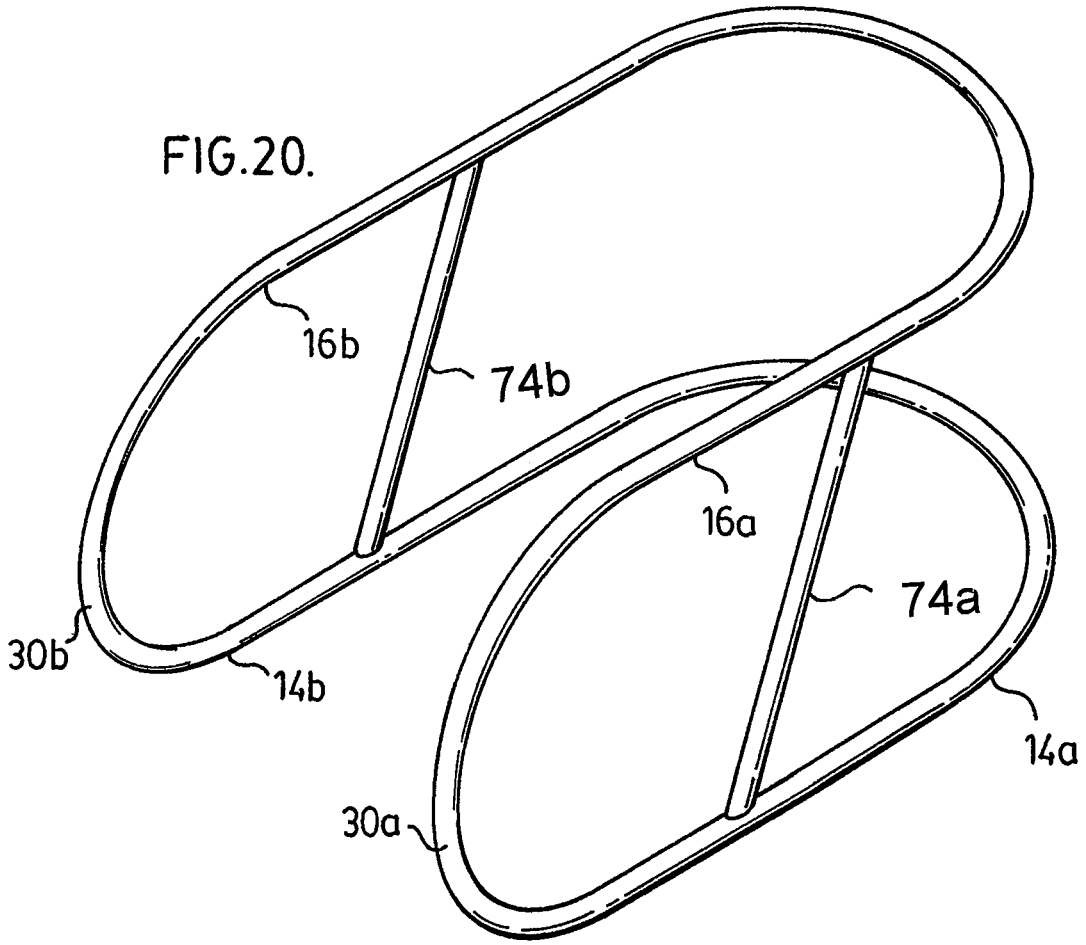
FIG. 20 is a perspective view from the rear of a further alternate construction of a frame for a walker in accordance with the instant invention wherein the frame is braced.

Preferably, the bracing is configured to maintain the spring effect when in use by heavy users, while also maintaining the racy aesthetic design or to decrease the reduction in the spring effect produced by the straight braces shown in FIGS. 19 and 20, and in fact may be configured to produce resilient bracing. For example, U-shaped support members 30 may be provided with a reinforcing rib on the interior side of the U-shape (where compressional force is maximized during weighting of the upper portion) forming a 'T' beam that still provides a spring effect during normal use, but which is more stable under duress when a heavy user leans or falls onto the upper portion or is seated suspended from the upper portion.

Figure 26:
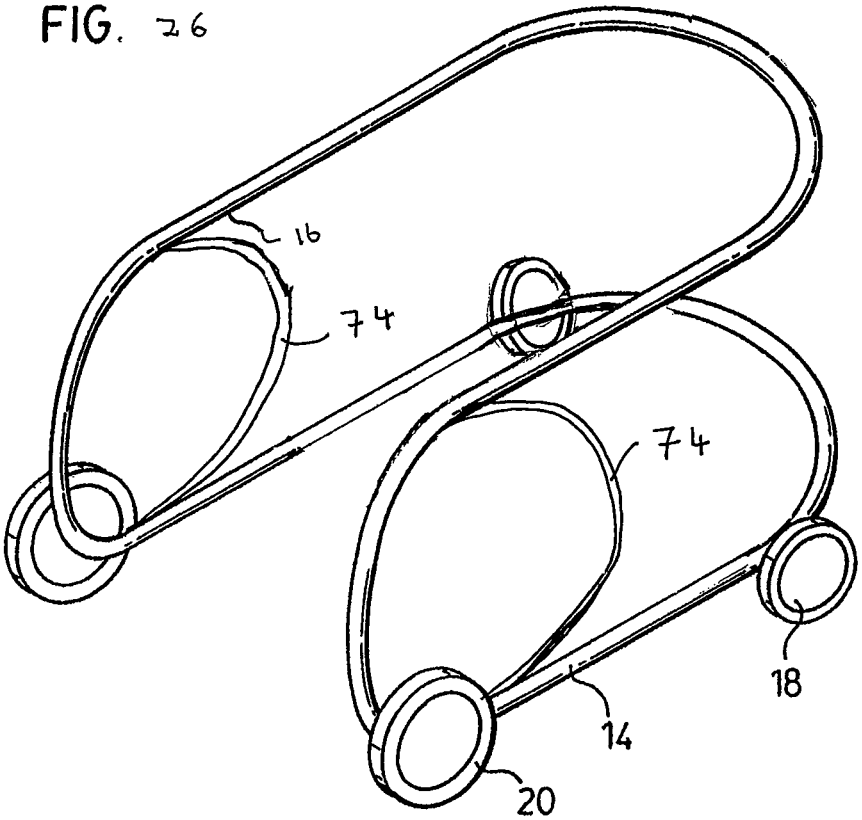
FIGS. 26-28 exemplify alternate resilient braces that may be utilized.

Alternately, or in addition, the braces may be arcuate in shape. As exemplified in FIG. 26, brace 74 is U-shape but in the opposite direction of support members 30. Accordingly, support members 30 and braces 74 produce a circular shape, and maintain the spring effect of U-shaped support members 30 during normal operation, while providing additional structural strength under excess weight. This circular design for support members 30 and braces 74 between the upper and lower portions forms a natural torsion spring in itself, and provides a method of reinforcing the U-shaped support members 30 when under heavy loading. In addition, the benefit of loading the rear wheels more than the front wheels for ease of movement over objects and turning is also retained, since braces 74 preferably join lower portion 14 at about the same location as the U-shaped support members 30. Downward force exerted by the user's hands upon the upper portion is transferred to lower portion 14 near the rear wheels, and not near the front wheels, even with this additional bracing.

Figure 27:
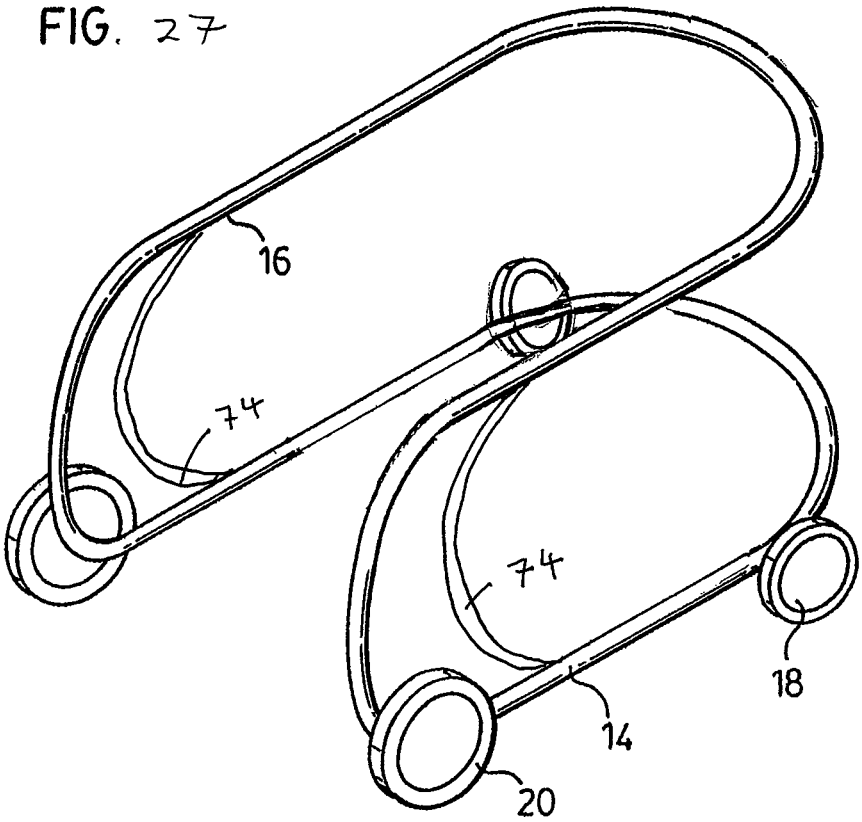

In the alternate embodiment of FIG. 27, arcuate braces 74 are arranged to curve in the same direction as support members 30. The use of such brace members still provides resilient bracing.

Figure 28:
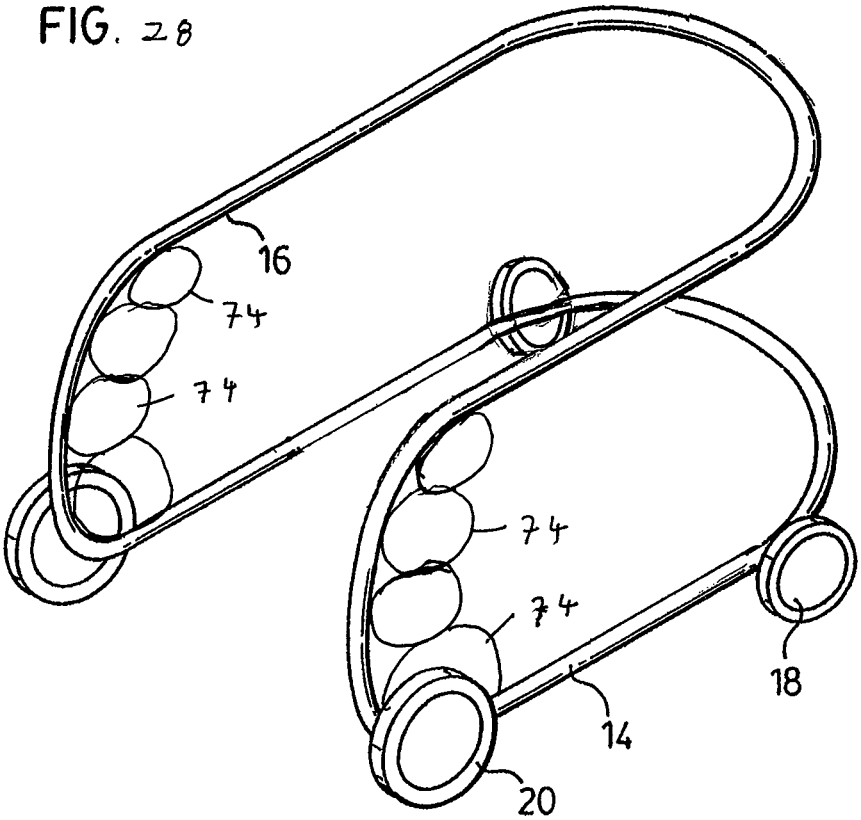

In a further alternate embodiment, as exemplified in FIG. 28, a plurality of circular rings 74 that extend between upper portion 16 and lower portion 14 may be used to provide resilient bracing. Rings 74 may be secured together by any means known in the art, such as by welding or by being molded as an integral set of rings, and may be combined with arcuate braces as in FIG. 27 to form a stronger grid beam structure. Further, as exemplified in FIG. 28, rings 74 may also be secured to support members 30.

Figure 21:
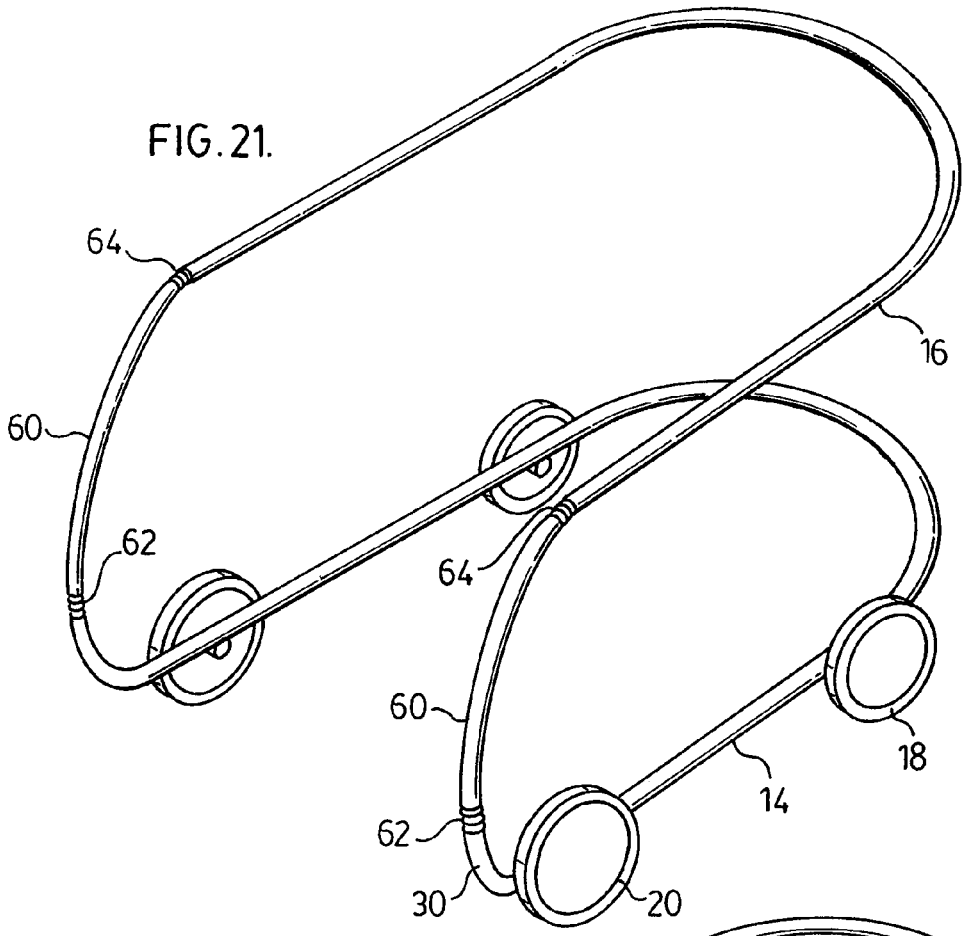
FIG. 21 is a perspective view from the rear of a further alternate construction of a frame for a walker in accordance with the instant invention wherein the frame is collapsible.
Figure 22:
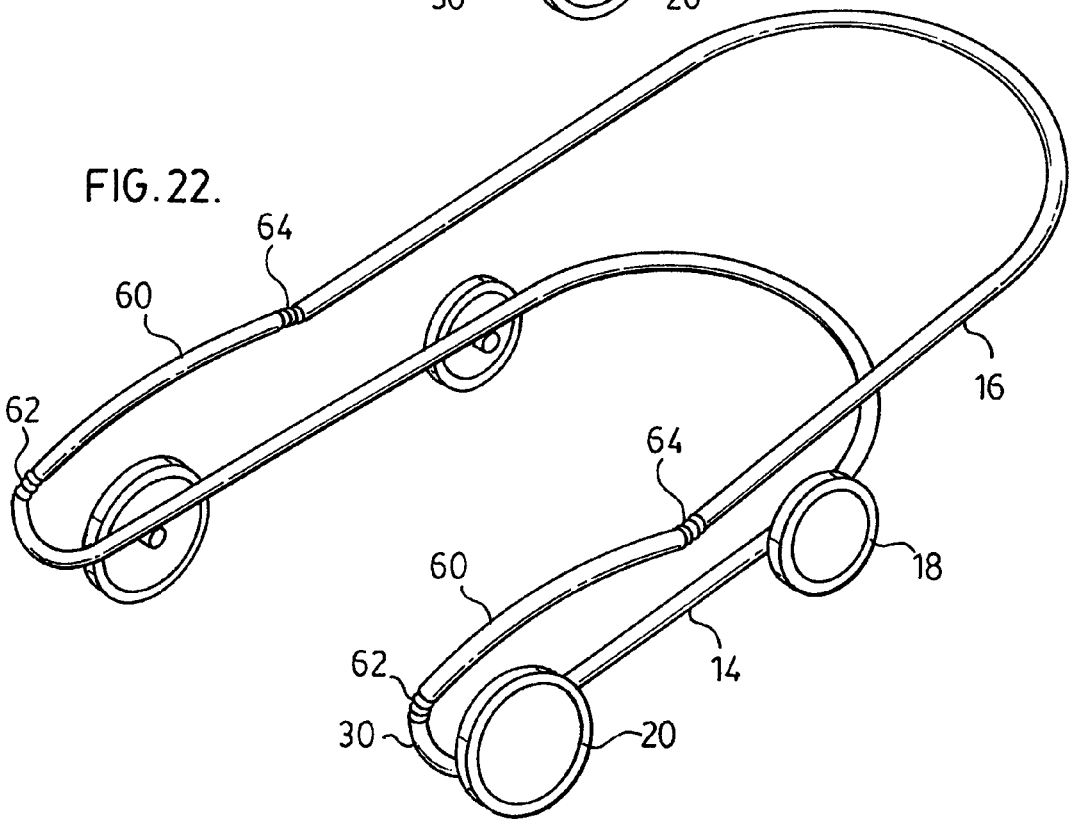
FIG. 22 is a perspective view from the rear of the further alternate construction of FIG. 21 wherein the frame has been collapsed.

In accordance with a further alternate embodiment, walker frame 12 may be collapsible or disassemblable. For example, referring to FIGS. 21 and 22, support member 30 may have a hinged section 60. A lower hinge 62 and an upper hinge 64 are provided. When hinges 62, 64 are released, upper portion 16 may be folded down to a position adjacent lower portion 14, thereby enhancing the ability to transport walker frame 12. In an alternate embodiment, referring to FIGS. 23 and 24, support members 30 could have one portion that is slideably mounted to the other portion. For example, lower part 66 of support member may have a male portion 80 at the end of thin neck portion 68 that is lockingly receivable in upper part 70 of support member 30. Accordingly, as exemplified in FIGS. 23 and 24, a lock, not shown positioned inside upper part 70, may be released, e.g., by pressing button 78, permitting upper portion 16 to slide upwardly off of lower portion 14 and then placed on lower portion 14.

Figure 25:
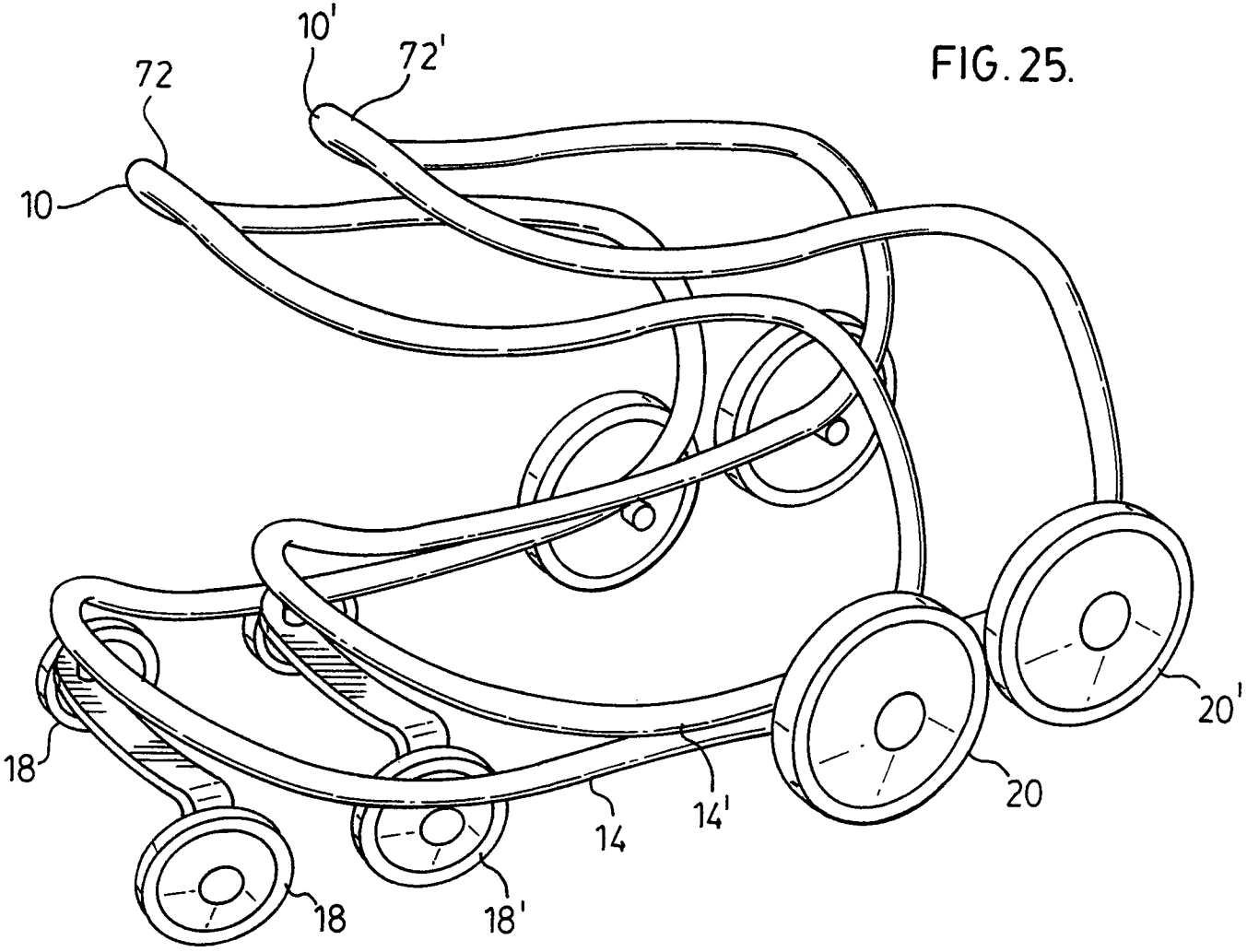
FIG. 25 is a perspective view of a further alternate embodiment for a frame for a walker wherein the frame is configured to permit walkers to be nested.

In a further alternate embodiment, the frame may be configured, such as by being wider at the rear then at the front, so as to permit two or more walkers to be nested (see for example FIG. 25 wherein walker 10' is nested in walker 10). One advantage of this design is that it permits a plurality of walkers to be stored in a reduced footprint.

It will be appreciated by those skilled in the art that various modifications of the mobility assistance device may be made and that each of them is within the scope of the following claims. It will also be appreciated that the various embodiments may be combined in any combination or sub-combination of features and that each of those form part of the invention disclosed herein.

The invention claimed is:

1. A walker for assisting a person traveling over a surface, the walker comprising:

a generally U-shaped base portion comprising a front end and a rear end and including first and second generally longitudinally extending, spaced apart, opposed side members that define a generally open area between the side members and having surface engaging members affixed directly thereto such that in use the base portion is positioned proximate to the surface;

an upper portion positioned above the base portion and comprising first and second opposed, generally horizontally extending handle sections that define a generally open area that is open at the rear wherein the handle sections are spaced apart so that a person using the walker is positioned between the generally horizontally extending handle sections, each handle section comprising a horizontal portion, a front end and a rear end; and, a pair of support members, each support member being arcuate and extending between the base portion and one of the rear ends of the upper portion, the support member configured and positioned such that all of the upper portion is cantilevered to absorb shocks as the walker travels over an uneven surface wherein the surface engaging members comprise a plurality of wheels affixed to the base portion, the plurality of wheels comprise two rear wheels and at least one front wheel and the rear wheels are canted inwardly.

2. A walker for assisting a person traveling over a surface, the walker comprising:

a generally U-shaped base portion comprising a front end and a rear end and including first and second generally longitudinally extending, spaced apart, opposed side members that define a generally open area between the side members and having surface engaging members affixed directly thereto such that in use the base portion is positioned proximate to the surface;

an upper portion positioned above the base portion and comprising first and second opposed, generally horizontally extending handle sections that define a generally open area that is open at the rear wherein the handle sections are spaced apart so that a person using the walker is positioned between the generally horizontally extending handle sections, each handle section comprising a horizontal portion, a front end and a rear end; and, a pair of support members, each support member being arcuate and extending between the base portion and one of the rear ends of the upper portion, the support member configured and positioned such that all of the upper portion is cantilevered to absorb shocks as the walker travels over an uneven surface wherein the surface engaging members comprise a plurality of wheels affixed to the base portion, the plurality of wheels comprise two rear wheels and at least one front wheel and the walker further comprises rear wheels attachment members comprising generally horizontal springs.

3. A walker for assisting a person traveling over a surface, the walker frame comprising:

a generally U-shaped base portion comprising a front end and a rear end and including first and second generally longitudinally extending, spaced apart, opposed side members that define a generally open area between the side members and having surface engaging members affixed directly thereto such that in use the base portion is positioned proximate to the surface;

an upper portion positioned above the base portion and comprising first and second opposed, generally horizontally extending handle sections that define a generally open area that is open at the rear wherein the handle sections are spaced apart so that a person using the walker frame is positioned between the generally horizontally extending handle sections, each handle section comprising a horizontal portion, a front end and a rear end;

a pair of support members, each support member being arcuate and extending between the base portion and one of the rear ends of the upper portion, the support member configured and positioned such that all of the upper portion is cantilevered to absorb shocks as the walker travels over an uneven surface; and, a seat mounted on at least one of the base portion, upper portion, and support member.

4. The walker of claim 3 wherein the seat comprises a child seat.

5. The walker of claim 3 wherein the seat comprises a seat for an adult.

6. An adult walker having a front end and an open rear end, the walker comprising:

a generally U-shaped base portion having a front end and an open rear end and including first and second generally longitudinally extending, spaced apart, opposed side members that define a generally open area between the side members and includes a central portion in which a user is positioned when using the walker;

surface engagement members provided on the walker, wherein the surface engagement members comprise rear wheels that are canted inwardly;

a generally U-shaped upper portion having a front end, a generally horizontally extending central portion and an open rear end; and, arcuate support members extending between the rear end of the upper portion and the rear end of the base portion whereby the upper portion is cantilevered to absorb shocks as the walker travels over an uneven surface.

7. An adult walker having a front end and an open rear end, the walker comprising:

a generally U-shaped base portion having a front end and an open rear end and including first and second generally longitudinally extending, spaced apart, opposed side members that define a generally open area between the side members and includes a central portion in which a user is positioned when using the walker;

surface engagement members provided on the walker comprising rear wheels;

a generally U-shaped upper portion having a front end, a generally horizontally extending central portion and an open rear end;

arcuate support members extending between the rear end of the upper portion and the rear end of the base portion whereby the upper portion is cantilevered to absorb shocks as the walker travels over an uneven surface; and, the rear wheels having rear wheels attachment members comprising generally horizontal springs.

* * * * *